US007777770B2

(12) United States Patent
Moreland et al.

(10) Patent No.: US 7,777,770 B2
(45) Date of Patent: Aug. 17, 2010

(54) DUAL-SIDED TWO-PLY DIRECT THERMAL IMAGE ELEMENT

(75) Inventors: Richard Moreland, Centerville, OH (US); Mary Ann Wehr, Hamilton, OH (US)

(73) Assignee: NCR Corporation, Duluth, GA (US)

( * ) Notice: Subject to any disclaimer, the term of this patent is extended or adjusted under 35 U.S.C. 154(b) by 267 days.

(21) Appl. No.: 11/682,497

(22) Filed: Mar. 6, 2007

(65) Prior Publication Data

US 2007/0211135 A1 Sep. 13, 2007

Related U.S. Application Data

(63) Continuation-in-part of application No. 11/675,649, filed on Feb. 16, 2007, and a continuation-in-part of application No. 11/644,262, filed on Dec. 22, 2006, and a continuation-in-part of application No. 11/633,300, filed on Dec. 4, 2006, and a continuation-in-part of application No. 11/559,515, filed on Nov. 14, 2006, and a continuation-in-part of application No. 11/595,364, filed on Nov. 9, 2006, and a continuation-in-part of application No. 11/581,318, filed on Oct. 16, 2006, now abandoned, and a continuation-in-part of application No. 11/549,463, filed on Oct. 13, 2006, and a continuation-in-part of application No. 11/203,326, filed on Aug. 11, 2006, and a continuation-in-part of application No. 11/297,706, filed on Dec. 8, 2005.

(60) Provisional application No. 60/779,782, filed on Mar. 7, 2006, provisional application No. 60/779,781, filed on Mar. 7, 2006.

(51) Int. Cl.
*B41J 2/325* (2006.01)
*B41M 5/00* (2006.01)

(52) U.S. Cl. ..... 347/171; 347/221

(58) Field of Classification Search ..... 347/221, 347/171; 400/82, 188
See application file for complete search history.

(56) References Cited

U.S. PATENT DOCUMENTS 3,947,854 A 3/1976 Hansen et al.
4,167,392 A 9/1979 Defago (Continued)

FOREIGN PATENT DOCUMENTS

EP 0947340 10/1999

(Continued)

OTHER PUBLICATIONS

JP Abstract, vol. 007, No. 063 (M-200), Mar. 16, 1983 & JP 57-208298 A (Ricoh KK), Dec. 21, 1982.

(Continued)

*Primary Examiner*—Huan H Tran

(57) ABSTRACT

A dual-sided two-ply direct thermal image element is provided. In one embodiment, the dual-sided two-ply direct thermal image element comprises a first substrate having a first side and a second side, and a second substrate having a first side and a second side, wherein both the first substrate and the second substrate include a thermally sensitive coating on at least a first side thereof, and wherein the second side of the first substrate is releasably attached to the second side of the second substrate.

21 Claims, 15 Drawing Sheets

U.S. PATENT DOCUMENTS

| | | | | |
|---|---|---|---|---|
| RE30,116 | E | | 10/1979 | Maalouf |
| 4,309,255 | A | | 1/1982 | Gendler et al. |
| 4,507,669 | A | | 3/1985 | Sakamoto et al. |
| 4,708,500 | A | | 11/1987 | Bangs et al. |
| 4,853,256 | A | * | 8/1989 | Obringer et al. ..... 427/152 |
| 4,956,251 | A | | 9/1990 | Washizu et al. |
| 4,965,166 | A | | 10/1990 | Hosoi et al. |
| 5,055,373 | A | | 10/1991 | Saeki et al. |
| 5,101,222 | A | | 3/1992 | Hakkaku |
| 5,132,704 | A | | 7/1992 | Nakagawa |
| 5,196,297 | A | | 3/1993 | Dombrowski, Jr. et al. |
| 5,214,750 | A | | 5/1993 | Minowa et al. |
| 5,266,550 | A | | 11/1993 | Asajima et al. |
| 5,284,816 | A | | 2/1994 | Stephenson |
| 5,366,952 | A | | 11/1994 | Granquist |
| 5,398,305 | A | | 3/1995 | Yawata et al. |
| 5,428,714 | A | | 6/1995 | Yawata et al. |
| 5,437,004 | A | | 7/1995 | Miyasaka et al. |
| 5,555,349 | A | | 9/1996 | Miyasaka et al. |
| 5,584,590 | A | | 12/1996 | Ito et al. |
| 5,594,653 | A | | 1/1997 | Akiyama et al. |
| 5,629,259 | A | | 5/1997 | Akada et al. |
| 5,639,169 | A | | 6/1997 | Aruga |
| 5,677,722 | A | | 10/1997 | Park |
| 5,692,110 | A | | 11/1997 | Miyasaka et al. |
| 5,707,925 | A | | 1/1998 | Akada et al. |
| 5,710,094 | A | | 1/1998 | Minami et al. |
| 5,755,521 | A | | 5/1998 | Ito et al. |
| 5,756,188 | A | | 5/1998 | Reiter et al. |
| 5,763,356 | A | | 6/1998 | Ueno et al. |
| 5,789,340 | A | | 8/1998 | Brust et al. |
| 5,792,725 | A | | 8/1998 | Simpson et al. |
| 5,794,530 | A | | 8/1998 | Dobashi et al. |
| 5,800,081 | A | | 9/1998 | Teradaira et al. |
| 5,815,191 | A | | 9/1998 | Michielsen et al. |
| 5,846,900 | A | | 12/1998 | Reiter et al. |
| 5,876,836 | A | | 3/1999 | Imamura et al. |
| 5,883,043 | A | | 3/1999 | Halbrook, Jr. et al. |
| 5,886,725 | A | | 3/1999 | Miyadera et al. |
| 5,918,910 | A | | 7/1999 | Stillwagon et al. |
| 5,964,541 | A | | 10/1999 | Murison et al. |
| 6,095,414 | A | | 8/2000 | Long et al. |
| 6,130,185 | A | | 10/2000 | Narita et al. |
| 6,150,067 | A | | 11/2000 | Koike et al. |
| 6,210,777 | B1 | | 4/2001 | Vermeulen et al. |
| 6,388,692 | B1 | | 5/2002 | Iwata et al. |
| 6,562,755 | B1 | | 5/2003 | Halbrook, Jr. et al. |
| 2006/0159503 | A1 | * | 7/2006 | Janning ..... 400/120.01 |
| 2007/0210572 | A1 | * | 9/2007 | Halbrook et al. ..... 283/62 |
| 2007/0211094 | A1 | * | 9/2007 | Roth et al. ..... 347/14 |
| 2007/0211099 | A1 | * | 9/2007 | Lyons et al. ..... 347/16 |
| 2007/0211132 | A1 | * | 9/2007 | Lyons et al. ..... 347/190 |
| 2007/0211134 | A1 | * | 9/2007 | VanDemark ..... 347/220 |
| 2007/0211135 | A1 | * | 9/2007 | Moreland et al. ..... 347/221 |
| 2007/0212146 | A1 | * | 9/2007 | Lyons et al. ..... 400/82 |
| 2007/0212515 | A1 | * | 9/2007 | Roth et al. ..... 428/98 |
| 2007/0213213 | A1 | * | 9/2007 | Roth et al. ..... 503/206 |
| 2007/0213214 | A1 | * | 9/2007 | Roth et al. ..... 503/226 |
| 2007/0213215 | A1 | * | 9/2007 | Dashiell et al. ..... 503/226 |
| 2007/0244005 | A1 | * | 10/2007 | Roth et al. ..... 503/226 |

FOREIGN PATENT DOCUMENTS

| | | |
|---|---|---|
| GB | 2 250 478 | 6/1992 |
| WO | WO 2007/102879 | 9/2007 |

OTHER PUBLICATIONS

JP Abstract, vol. 007, No. 081 (M-105), Apr. 5, 1983 & JP 58-008668 A (Shinko Denki KK), Jan. 18, 1983.

JP Abstract, vol. 015, No. 194 (M-1114), May 20, 1991 & JP 03-051149 A (Fujitsu General Ltd.), Mar. 5, 1991.

JP Abstract, vol. 2000, No. 24, May 11, 2001 & JP 2001-199095 A (Alps Electric Co. Ltd.), Jul. 24, 2001.

JP Abstract, vol. 1998, No. 08, Jun. 30, 1998 & JP 10-076713 A (Sony Corp.), Mar. 24, 1998.

JP Abstract, vol. 010, No. 151 (M-483), May 31, 1986 & JP 61-003765 A (Konishiroku Shashin Kogyo KK), Jan. 9, 1986.

JP Abstract, vol. 016, No. 041 (M-1206), Jan. 31, 1992 & JP 03-246091 A (Canon Inc.), Nov. 1, 1991.

Boca Systems Micro Plus 2S 2 Sided Printer product brochure which came to the attention of Applicant at a Chicago tradeshow during the summer of 2002.

* cited by examiner

DUAL-SIDED TWO-PLY DIRECT THERMAL IMAGE ELEMENT

CROSS REFERENCE TO RELATED APPLICATIONS

This application is a non-provisional of and claims priority to U.S. Provisional Application No. 60/779,781 entitled "Two-Sided Thermal Printing" and filed on Mar. 7, 2006, and U.S. Provisional Application No. 60/779,782 entitled "Dual-Sided Thermal Printer" and filed on Mar. 7, 2006; the disclosures of which are incorporated by reference herein. This application is also co-pending with and claims priority as a continuation-in-part to the following references: U.S. application Ser. No. 11/503,326 entitled "Dual-Sided Thermal Pharmacy Script Printing" and filed on Aug. 11, 2006, U.S. application Ser. No. 11/581,318 entitled "UV and Thermal Guard" and filed on Oct. 16, 2006 now abandoned, U.S. application Ser. No. 11/549,463 entitled "Dual-Sided Thermal Security Features" and filed on Oct. 13, 2006, U.S. application Ser. No. 11/633,300 entitled "Multi-Color Dual-Sided Thermal Printing" and filed on Dec. 4, 2006, U.S. application Ser. No. 11/595,364 entitled "Multisided Thermal Media Combinations" and filed on Nov. 9, 2006, U.S. application Ser. No. 11/559,515 entitled "Two-Sided Thermal Wrap Around Label" and filed on Nov. 14, 2006, U.S. application Ser. No. 11/644,262 entitled "Two-Sided Thermal Print Sensing" and filed on Dec. 22, 2006, U.S. application Ser. No. 11/675,649 entitled "Two-Sided Thermal Print Switch" and filed on Feb. 16, 2007 (which application is a continuation-in-part of U.S. application Ser. No. 11/297,706 entitled "Dual-Sided Thermal Printing and filed on Dec. 8, 2005 and a continuation-in-part of U.S. application Ser. No. 11/644,262 entitled "Two-Sided Thermal Print Sensing" and filed on Dec. 22, 2006), and U.S. application Ser. No. 11/678,216 entitled "Two-Sided Thermal Print Configurations" and filed on Feb. 23, 2007 (which application is a continuation-in part of U.S. application Ser. No. 11/644,262 entitled "Two-Sided Thermal Print Sensing" and filed on Dec. 22, 2006 and a continuation-in-part of U.S. application Ser. No. 11/675,649 entitled "Two-Sided Thermal Print Switch" and filed on Feb. 16, 2007), the disclosures of which (except U.S. application Ser. No. 11/297,706) are hereby incorporated by reference herein.

BACKGROUND

Two, or dual-sided direct thermal printing of documents such as transaction documents and receipts is described in U.S. Pat. Nos. 6,784,906 and 6,759,366. In dual-sided direct thermal printing, the printers are configured to allow concurrent printing on both sides of thermal media moving along a feed path through the printer. In such printers a direct thermal print head is disposed on each side of the media along the feed path. In operation each thermal print head faces an opposing platen across the media from the respective print head.

In direct thermal printing, a print head selectively applies heat to paper or other media comprising a substrate with a thermally sensitive coating. The coating changes color when heat is applied, by which "printing" is provided on the coated substrate. For dual-sided direct thermal printing, the media substrate may be coated on both sides.

SUMMARY

Imaging elements for dual-sided direct thermal printing are described generally comprising one or more substrates and a thermally sensitive coating on at least one side of each of the one or more substrates.

In one embodiment, a dual-sided two-ply direct thermal image element is provided comprising a first substrate having a first side and a second side, and a second substrate having a first side and a second side, wherein both the first substrate and the second substrate include a thermally sensitive coating on at least a first side thereof, and wherein the second side of the first substrate is releasably attached to the second side of the second substrate.

The dual-sided two-ply direct thermal image element may further be thermally imaged to include merchant-customer transaction information on a first side of the first and the second substrates, wherein the first substrate, when detached form the second substrate, acts as the customer receipt for the merchant-customer transaction, and the second substrate, when detached from the second substrate, acts as the merchant receipt for the merchant-customer transaction.

Alternative features, advantages and variations of the invention will be illustrated by example by the description to follow and the appended drawings and claims.

DETAILED DESCRIPTION

By way of example, various embodiments of the invention are described in the material to follow with reference to the included drawings. Variations may be adopted.

Background material applicable to direct thermal printing and related media production and common features generally is described in U.S. Pat. No. 6,803,344, the disclosure of which is hereby incorporated herein by reference.

Figure 1:
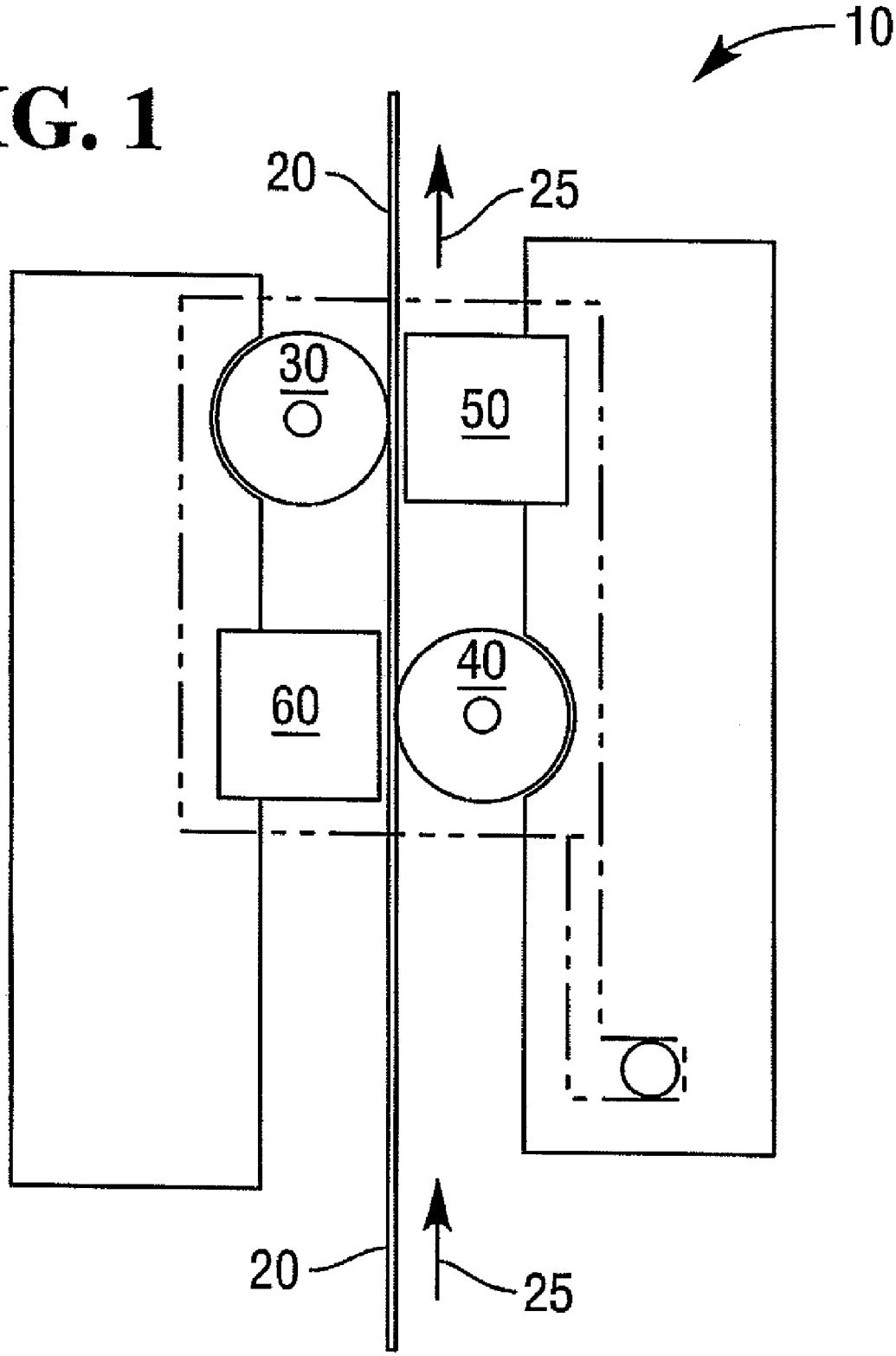
FIG. 1 shows a schematic of an example dual-sided imaging direct thermal printer useable for dual-sided, single pass printing of media such as transaction receipts or tickets.

FIG. 1 shows a schematic of a dual-sided imaging direct thermal printer 10 useable for dual-sided, single pass printing of transaction receipts or tickets at time of issue. The printer 10 operates on print media 20 which is double-sided thermal paper, e.g., comprising a cellulose-based or polymer substrate sheet coated on each side with heat sensitive dyes as described in U.S. Pat. Nos. 6,784,906 and 6,759,366. Multi-color printing capability can be provided on both sides of the receipt by using two or more dyes with sensitivity to different temperatures on a side where multi-color printing is desired. Substrates and heat sensitive color changing coatings for direct thermal printing media are generally well known in the art. Dual-sided direct thermal printing can be facilitated by a media 20 which includes dyes sensitive to different temperatures on opposite sides of the media 20, or by use of thermally resistant substrates to inhibit thermal printing on one side of the media 20 from affecting the coloration on the opposite side of the media 20.

As shown in FIG. 1, the printer 10 has rotating platens 30 and 40 and opposing thermal print heads 50 and 60 on opposite sides of the receipt or ticket media 20 and media feed path 25. Dual-sided direct thermal printing of the media 20 occurs in a single pass at the time of the transaction or when a receipt or ticket is issued. The media 20 can be cut or severed to provide an individual receipt or ticket document, typically once printing is completed.

Figure 2A:
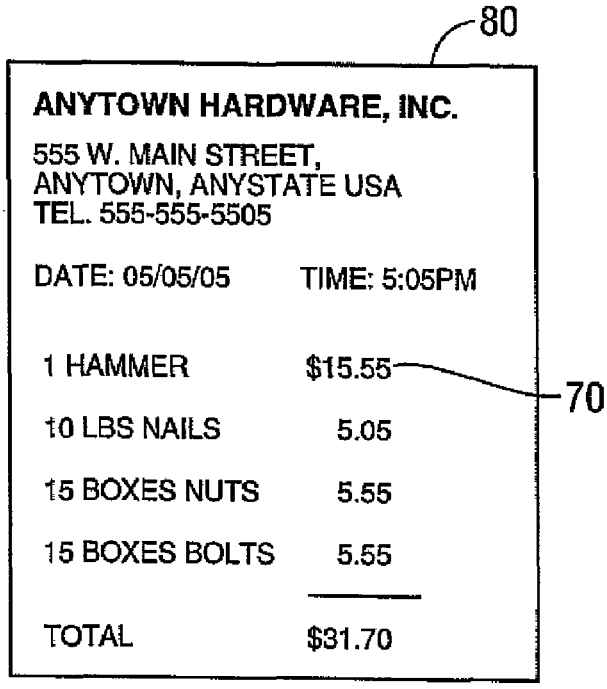
FIG. 2A shows an example receipt with transaction detail printed on the front side.
Figure 2B:
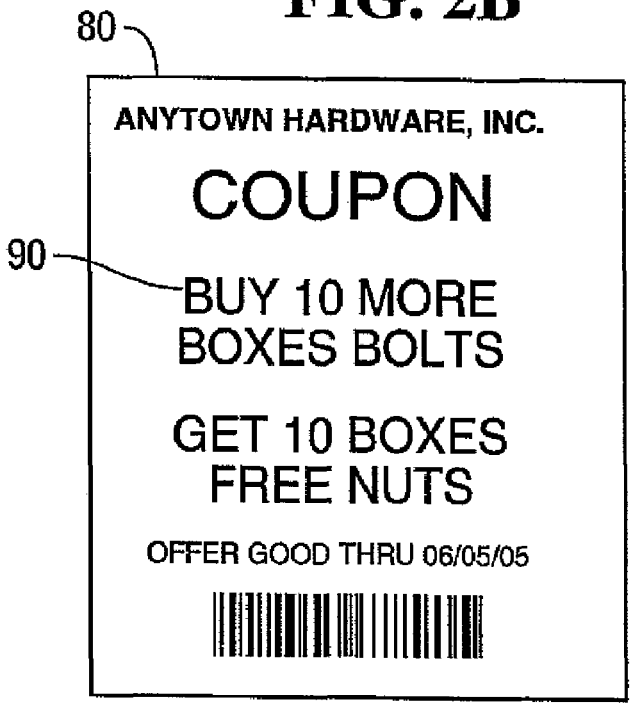
FIG. 2B shows the example receipt of FIG. 2A with supplemental information printed on the reverse side, such as variable stored information determined at the time of the transaction.

FIG. 2A shows transaction detail 70 such as issuer identification, time, date, line item entries and a transaction total printed on the front side of a receipt 80. FIG. 2B shows custom information 90, e.g., based on recipient identity or transaction detail ascertained at transaction time, printed on the reverse side of the receipt 80. For example, custom information 90 could include further or duplicate transaction information, a coupon as shown, rebate or contest information, serialized cartoons, conditions of sale, document images, advertisements, security features, ticket information, or other information, e.g., custom information based on recipient identity or transaction data or detail.

Exemplary media 20 comprises an opaque substrate and a thermally sensitive coating on each side for general two-sided direct thermal printing applications. The substrate or base sheet can comprise those materials used in conventional direct thermal printing applications, including materials derived from synthetic or natural fibers such as cellulose (natural) fibers, e.g., opaque paper, and polyester (synthetic) fibers. Substrates may also include plastics, e.g., extruded plastic films using materials such as Kapton, polyethylene or polyester polymers. Calendering is provided to produce a smoothness of 75 Bekk or greater on each side of the media 20 to improve the thermal imaging. A subcoat or base coat, e.g., predominantly of calcium carbonate or clay, and binder material, e.g. a latex-based binder, may be provided on paper substrates to enhance smoothness of finish and the quality of direct thermal printing. Without a subcoat, a typical smoothness achieved by calendaring of base paper before applying thermally sensitive coatings would be in the range of 75-150 Bekk. With a subcoat and calendaring a finished smoothness of 250 Bekk or greater is typical. To give higher quality thermal imaging characteristics, e.g., for bar code printing, a minimum finished smoothness of 300 Bekk should be used. Where used, a subcoat weight of about 1-10 lbs/3300 SFR (square foot ream) per side for one or both sides, preferably 2-5 lbs/3300 SFR per side for one or both sides, is generally typical.

Calendering to provide smoothness of the sides of the media 20 can comprise, e.g., on-line or off-line soft or soft nip calendaring or supercalendering in one or more pass operations. Supercalendering, typically performed off-line from a paper production line, may be performed using a stack of alternating chilled cast iron and fiber-covered rolls. The fiber-covered rolls may for example be covered with highly compressed paper for processing uncoated papers, or with highly compressed cotton for processing papers with coatings. In a soft calendar, a composite-covered crown roll can run against a heated metal roll, e.g., in an in-line process, to produce a desired sheet surface finish and gloss. To calendar both sides of the media 20 in one pass, two or more roll stacks may be used.

Calendering of both sides of the media 20 for two-sided direct thermal printing has the benefit of providing the desired degree of smoothness to achieve a print quality required for a given application. The smoother the media 20 the less the print head wear will be, and concomitant abrasion of the media 20. A calendered subcoated surface of the media 20 also minimizes substrate interaction with thermally sensitive coating components.

The thermally sensitive coatings are preferably of the dye-developing type particularly when used with opaque paper substrates for the media 20, e.g., for two-sided direct thermal printing applications. Such coatings would typically comprise a developer, an optional sensitizer and color former or dye, e.g., leuco-dye, and undergo a color change upon transfer of heat. Different thermally sensitive coatings, e.g., of the dye-developing type or the dye-sublimation type, can be used with, e.g., plastic substrate materials. The dye-developing type thermally sensitive coating, e.g., overlying the subcoat where used, would generally have a weight of about 1-8 lbs/3300 SFR, or preferably about 1-3 lbs/3300 SFR. Without a subcoat, the weight of a thermally sensitive layer will typically be greater.

A subcoat can be used on one side or both sides and the degree of calendering or finished smoothness can be the same or different on each side of the media 20, according to considerations of cost and the requirements of particular applications involved. For example, a higher quality of printing may be required for one side such as where printing of a bar code may be required. Such an application would normally require use of a subcoat and calendaring to a finished smoothness 300 Bekk or greater on the bar code print side of the media 20. The same finish or a less expensive finish might be used for the other side of the media 20. Similarly the character, chemical composition, thermal sensitivity and cost of the thermally sensitive coating could be the same or different on each of the two sides, e.g., a sensitizer may be used on one or both sides of the media 20 depending upon application. Different chemistries on the two sides of the media 20 can be employed to provide different environmental compatibilities or properties or other desired product characteristics.

The subcoat where used could be the same on each side or have a different composition or weight on each side of the media 20, again depending upon cost and application considerations. For example, if there is to be any ink jet printing as well as direct thermal printing on one side a calcium carbonate subcoat may be preferred.

The thermally sensitive coatings on each side of the media 20 can provide single color printing on each side of the media 20, where the print colors are the same or different on each side of the media 20. Alternatively, multiple color direct thermal printing may be implemented on one side or both sides, using multiple thermally sensitive coatings or multiple thermally sensitive layers within a coating, e.g., as taught in U.S. Pat. No. 6,906,735, or using multiple dyes within a coating layer, where the available print color choices are the same or different on each side of the media 20.

In some applications it may be desirable to provide the thermally sensitive coating on one or both sides of the media 20 in the form of a spot, strip or pattern coating or to provide for a spot, strip or pattern of special or higher cost finish on one or both sides. For example, to provide for printing of a bar code at a particular location on the media 20 the requisite smoothness of finish and thermally sensitive coating could be limited to that location. Repetitive sense marks could be applied to one or both sides of the media 20 to allow the bar code printing location to be identified during the bar code printing process. For some applications the sense marks could have different repeat lengths on opposite sides of the media 20, e.g., to allow for different intended print sizes.

For image protection and environmental durability, a top coat can be applied over the thermally sensitive coating on one or both sides of the media 20. Where used, the topcoat could comprise a spot, strip or pattern coating, e.g., for the added protection of a bar code. Repetitive sense marks could be applied to the media 20 to help identify the particular topcoat spot, strip or pattern locations.

To assist web severance or folding generally or in forms applications, repeating lines of perforation may be added to the media 20 in areas where separation or folding will be desired, e.g., to provide fan-folded multi-page documents printed on both sides.

The media 20 may be provided with one or more areas pre-printed by ink, thermal printing or other non-thermal printing on at least one side of the media 20, e.g., for security features, pre-printing of standard terms or advertising, depending on application requirements. The pre-printing could also provide a colored background area affecting the color of a final image. For example, yellow ink over a red image thermal paper could be used to provide an orange final image color.

For some applications the media 20 may be in the form of a two-ply web or comprise a two-ply substrate, e.g., for simultaneous printing of customer and merchant receipts and separable into the two separate receipt portions at a point of sale.

Figure 3A:
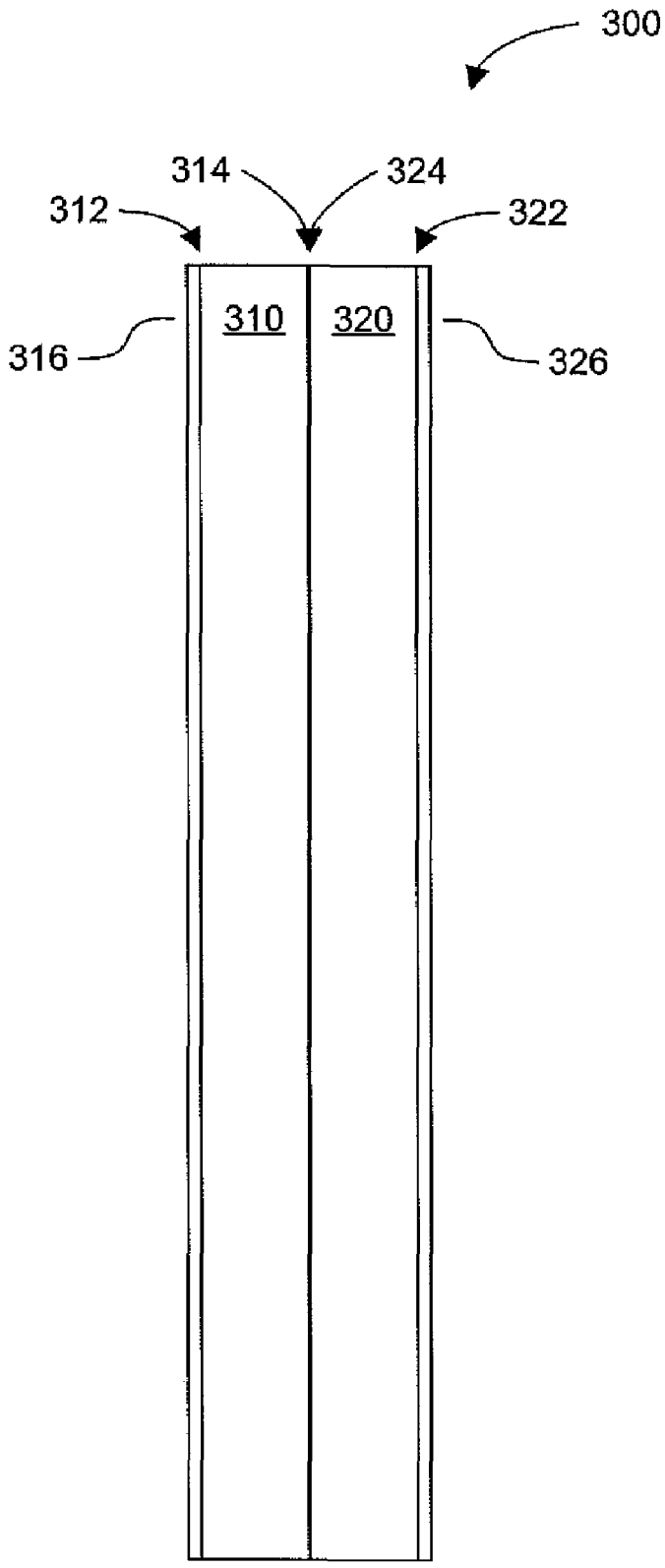
FIGS. 3A-3G illustrate various embodiments of a dual-sided two-ply direct thermal image element.

As shown in FIG. 3A, media 20 in the form of a two-ply web or two-ply substrate, and further identified as a dual-sided two-ply direct thermal image element 300, may comprise a first substrate 310 having a first side 312 and a second side 314, and a second substrate 320 having a first side 322 and a second side 324. As further shown in FIG. 3A, both the first substrate and the second substrate may include one or more thermally sensitive coatings 316, 326 on at least a first side thereof. Each thermally sensitive coating 316, 326 may comprise a full, spot or pattern coating, and may provide for single or multi-color thermal printing. Additionally, each of the first and/or second substrates 310, 320 may further include one or more base and/or top coats (not shown) associated with their respective first and/or second sides 312, 314, 322, 324. Where included, the one or more base and/or top coats may be provided under and/or on top of one or more included thermally sensitive coatings 316, 326.

As shown in FIG. 3A, a first substrate 310 of a dual-sided two-ply direct thermal image element 300 may be in a proximate relation to a second substrate 320 such that a second side 314 of the first substrate 310, and/or any coatings associated therewith, is in releasable contact with a second side 324 of the second substrate, and/or any coatings associated therewith. Such relation may be achieved by, inter alia, co-rolling of the first and the second substrates 310, 320 on a common spool or roll core for feed into a dual-sided direct thermal imaging printer such as the printer 10 of FIG. 1A.

Figure 3B:
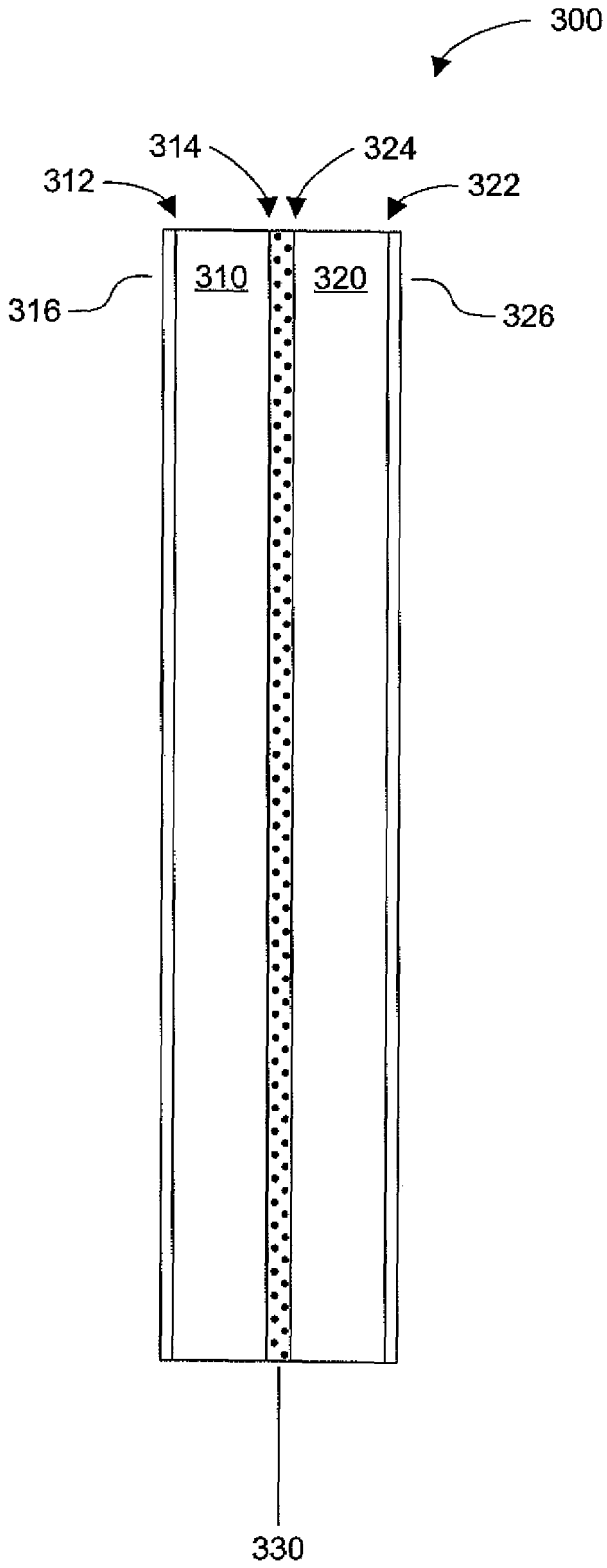

As shown in FIG. 3B, a dual-sided two-ply direct thermal image element 300 may further comprise one or more adhesive layers 330 for releasably attaching, inter alia, a second side 314 of a first substrate 310, including any coatings associated therewith, to a second side 324 of a second substrate 320, including any coatings associated therewith. Suitable adhesives include low tack adhesives which provide a low degree of residual tackiness or stickiness upon separation of the first and second substrates 310, 320, and/or no residual tack adhesives which leave no residual tackiness or stickiness upon separation of the first and second substrates 310, 320, and the like.

Figure 3C:
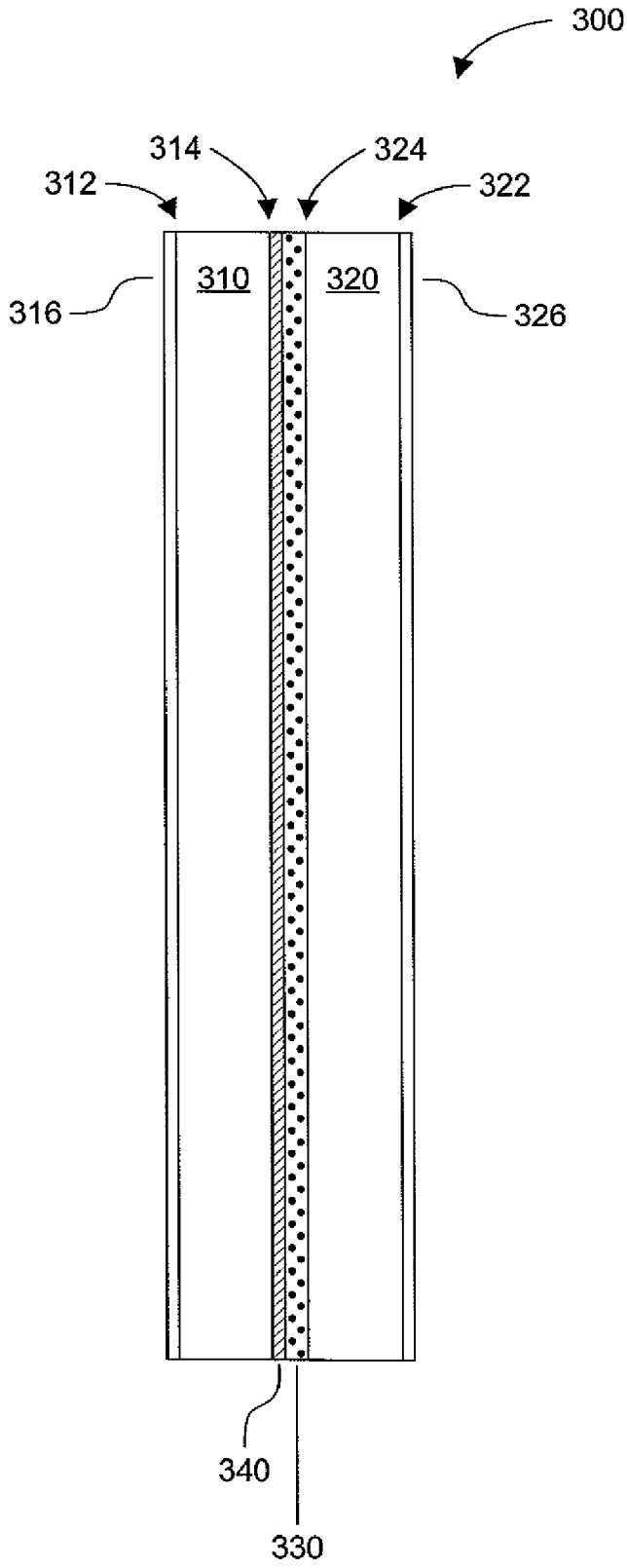

Additionally, and as shown in FIG. 3C, a dual-sided two-ply direct thermal image element 300 may further comprise one or more release layers or liners 340 proximate to a second side 314, 324 of a first and/or second substrate 310, 320, including any coatings associated therewith. Where provided, the one or more release layers or liners 340 may assist in releasably attaching the first substrate 310 to the second substrate 320. Likewise, use of a release layer or liner 340 affords an ability to utilize high tack adhesives in addition to low and/or no tack adhesives in the adhesive layer 330 for maintenance of residual tackiness or stickiness upon separation of the first and second substrates 310, 320.

Figure 3D:
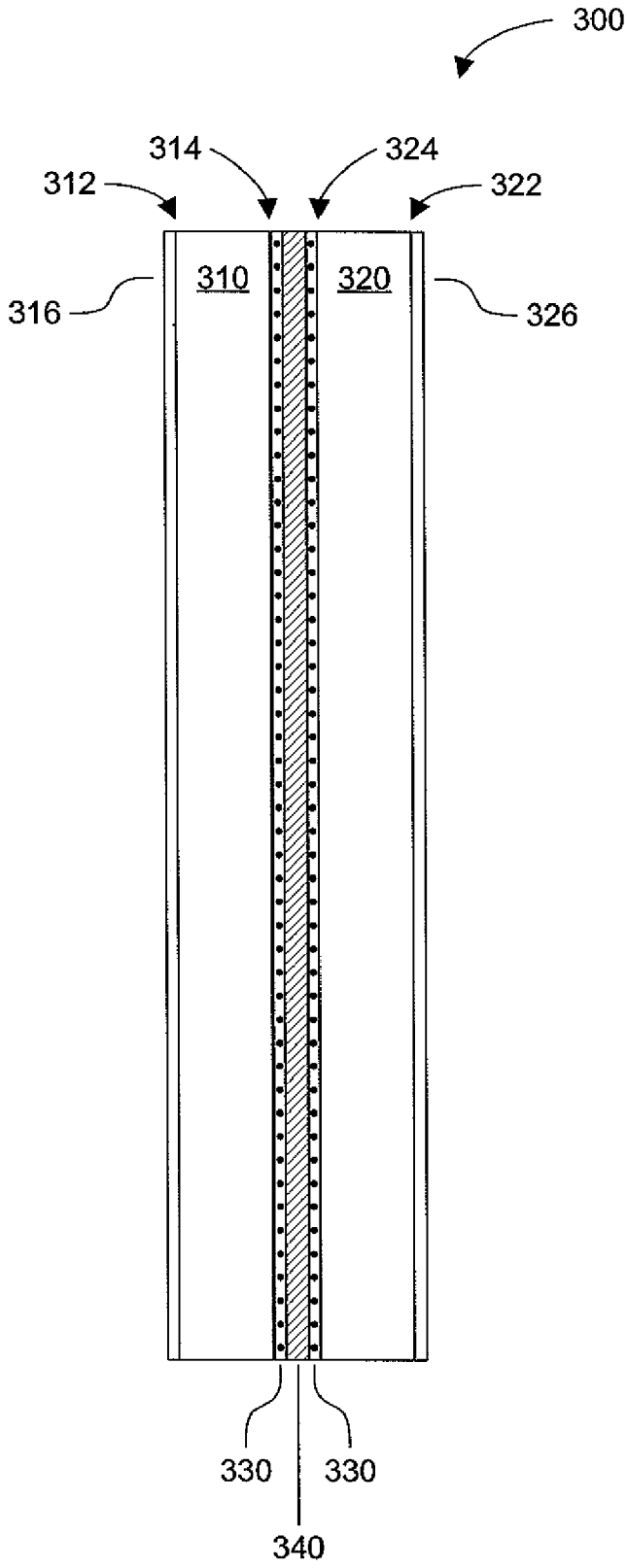

In one embodiment, a silicone release layer 340 is applied to a second side 314 of a first substrate 310, and a high tack hot melt adhesive 330 is applied to a second side 324 of a second substrate 320 such that, when removed from the first substrate 310, the second substrate 320 acts as an adhesive label. Additional variations, such as that shown in FIG. 3D where high or low residual tack adhesives 330 are applied to respective second sides 314, 324 of a first and a second substrate 310, 320, with or without provision of one or more additional release layers or release liners 340 in between, for creation of two adhesive labels, are also possible.

Figure 3E:
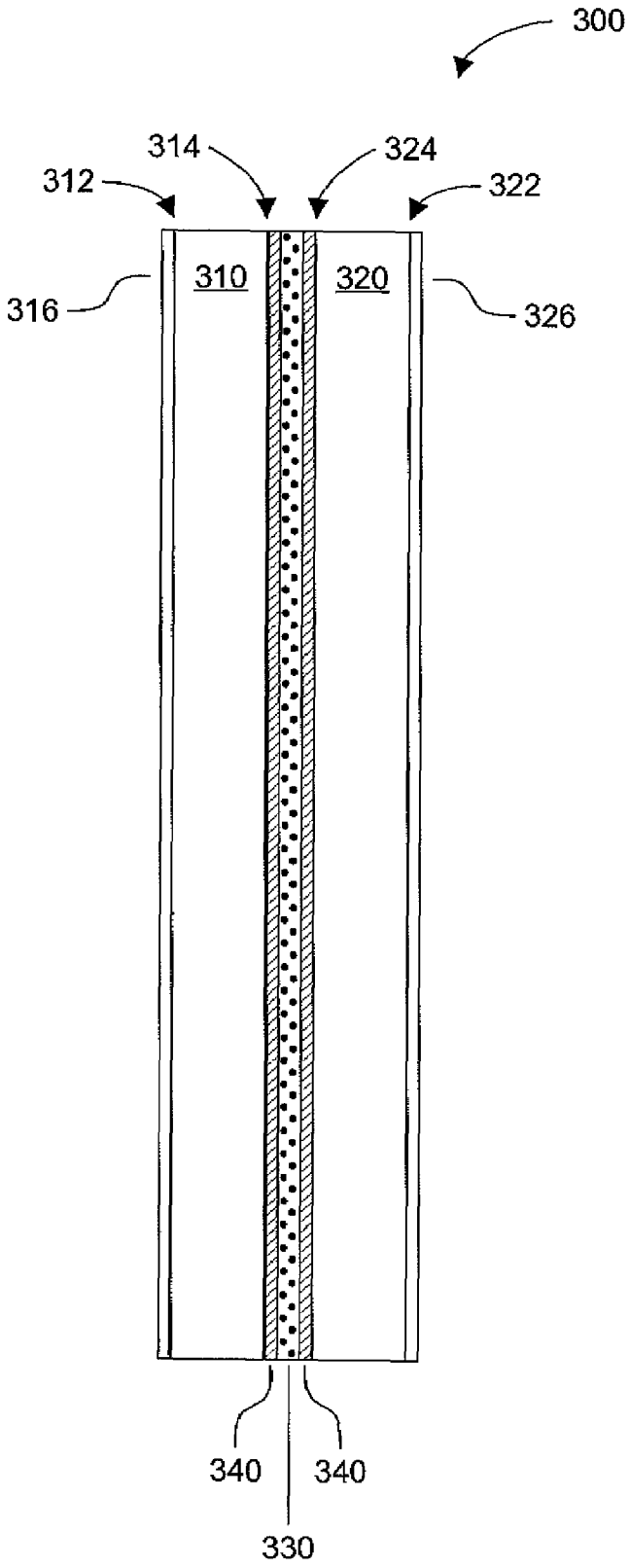

In further embodiments, such as shown in FIG. 3E, one or more adhesive layers 330 and/or one or more release layers 340 may be alternately situated such that, the one or more release layers 340 are in proximate relation to the respective second sides 314, 324 of the first and second substrates 310, 320, with the one or more adhesive layers 330 providing a releasable bond therebetween.

Figure 3F:
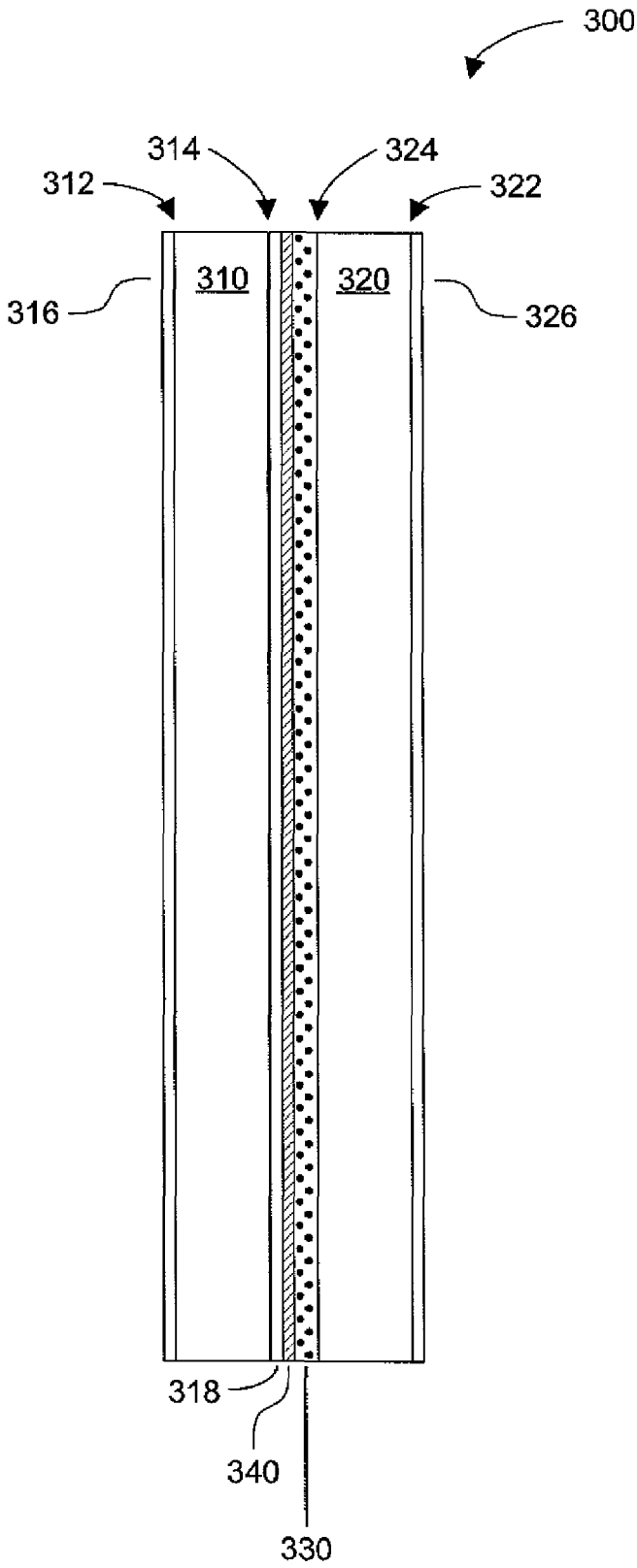

As shown in FIG. 3F, a dual-sided two-ply direct thermal image element may further comprise one or more thermally sensitive coatings 318 on a second side 314 of a first substrate 310 for imaging before, during and/or after imaging of one or both of the thermally sensitive coatings 316, 326 on the first sides of the first and second substrates 310, 320. As further shown in FIG. 3F, one or more adhesive 330 and/or release 340 layers may also be provided, which adhesive 330 and/or release layers 340 may, where provided, assist in maintaining integrity of the dual-sided two-ply direct thermal image element 300 and/or provide for variations in end use such as formation of one or more label elements upon separation of the first and second substrates 310, 320.

Figure 3G:
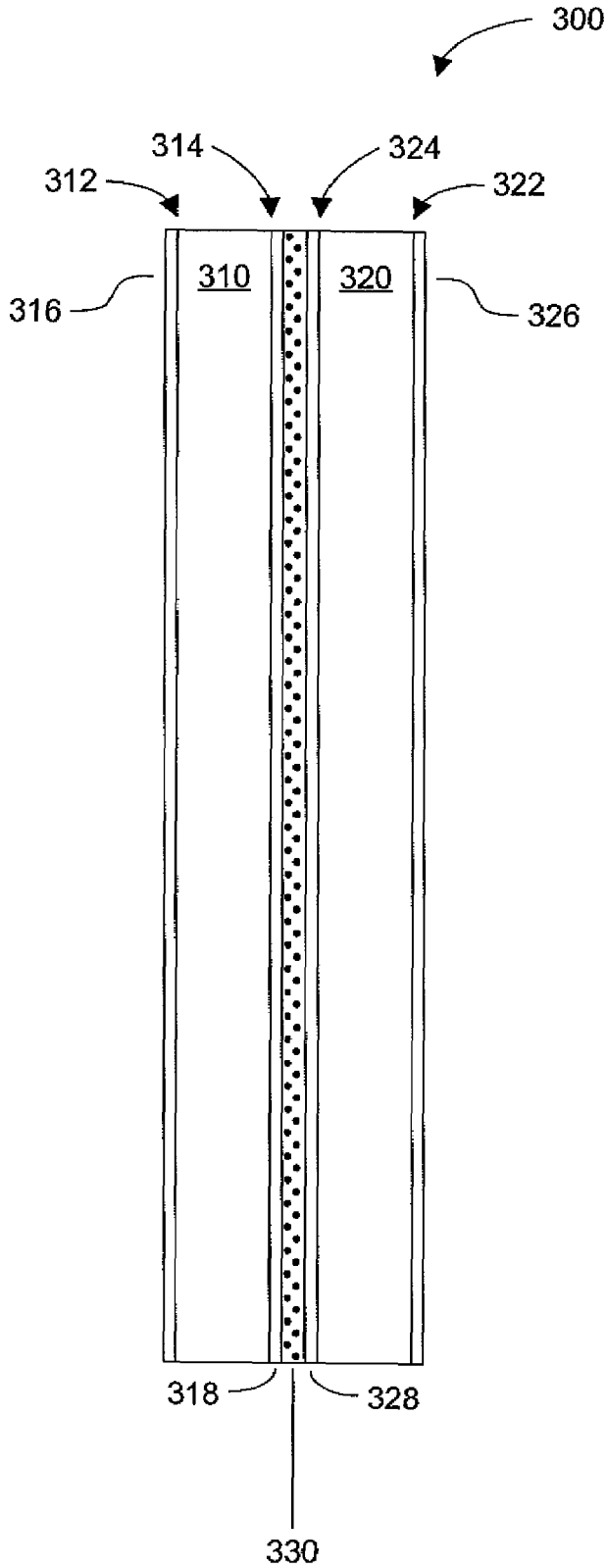

As shown in FIG. 3G, a dual-sided two-ply direct thermal image element 300 may also comprise one or more thermally sensitive coatings 318, 328 on second sides 314, 324 of first and second substrates 310, 320 for imaging before, during and/or after imaging of one or both thermally sensitive coatings 316, 326 on first sides 312, 322 of the first and second substrates 310, 320. Additionally, as shown in FIG. 3G, a dual-sided two-ply direct thermal image element 300 may further comprise one or more adhesive layers 330 for releasably attaching, inter alia, a second side 314 of a first substrate 310, including any coatings associated therewith, to a second side 324 of a second substrate 320, including any coatings associated therewith. As with any dual-sided two-ply direct thermal image element 300, variations may be provided for regarding inclusion of one or more release 340 layers, one or more base coatings, one or more top coatings, and/or one or more adhesives 330 with the first and/or second substrates 310, 320.

In some embodiments, first information may be thermally printed in a first thermally sensitive coating 316 associated with a first side 312 of a first substrate 310, and second information may be thermally printed in a second thermally sensitive coating 326 associated with a first side 322 of a second substrate 320 of a dual-sided two-ply direct thermal image element 300. Such information printing may occur through use of, inter alia, a dual-sided direct thermal printer such as the printer 10 of FIG. 1.

Alternately or additionally, in some embodiments, third information may be thermally printed in a thermally sensitive coating 318 associated with a second side 314 of a first substrate 310, and/or fourth information may be thermally printed in a thermally sensitive coating 328 associated with a second side 324 of a second substrate 320 of a dual-sided two-ply direct thermal image element 300. Such information may be printed in a multi-pass process using, inter alia, a dual-sided direct thermal printer such as the printer 10 of FIG. 1. Alternately or additionally, such information may be printed in a single-pass process using, inter alia, a suitable dual-sided direct thermal printer, such as the dual-sided two-ply direct thermal printer 400 associated with FIG. 3H.

Figure 3H:
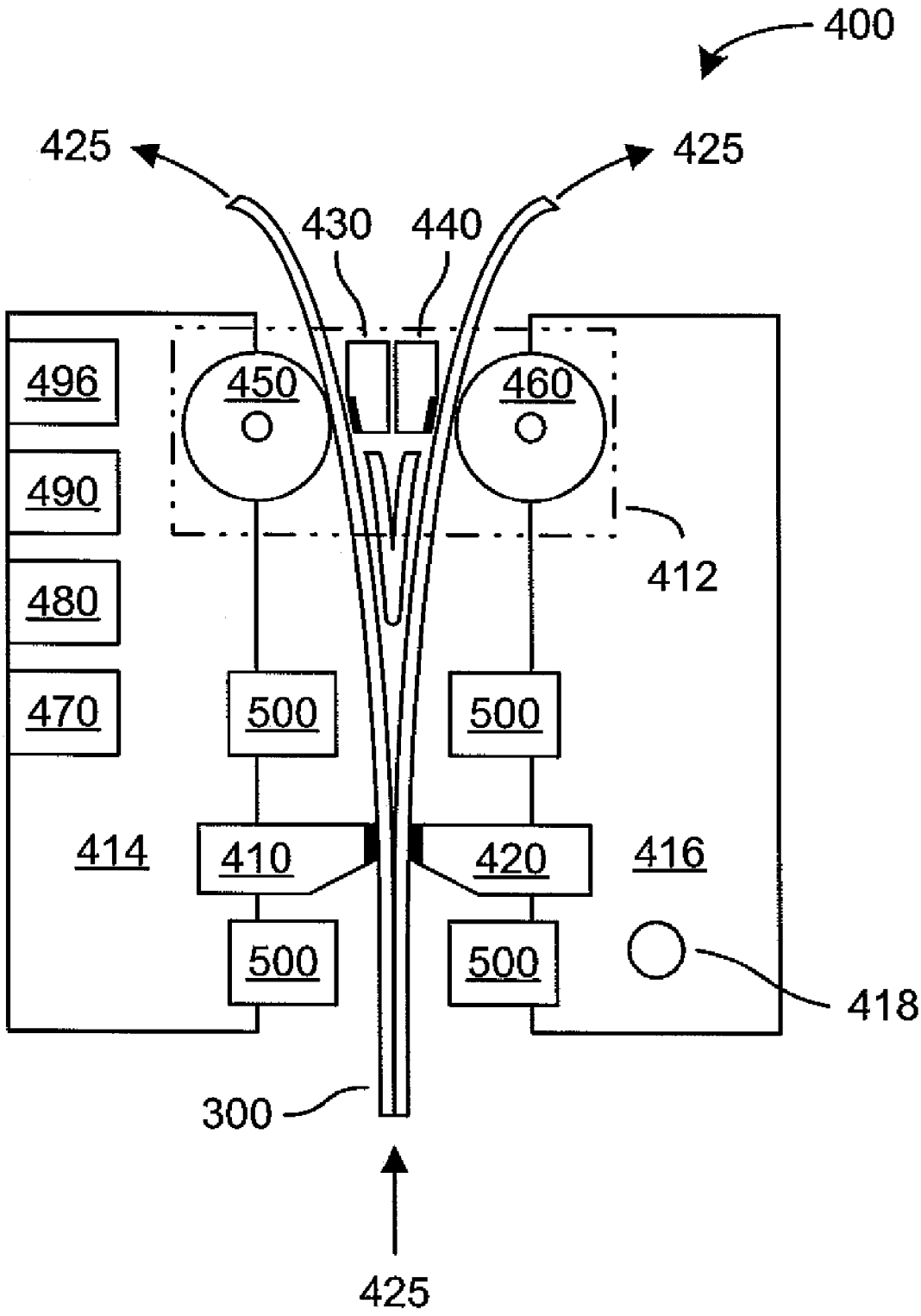
FIG. 3H illustrates an embodiment of a dual-sided two-ply direct thermal printer.

As shown in FIG. 3H, a dual-sided two-ply direct thermal printer 400 may comprise first and second thermal print heads 410, 420 for imaging thermally sensitive coatings 316, 326 associated with respective first sides 312, 322 of first and second substrates 310, 320 of a dual-sided two-ply direct thermal image element 300. Additionally, such dual-sided two-ply direct thermal printer 400 may comprise third and/or fourth thermal print heads 430, 440 for imaging thermally sensitive coatings 318, 328 associated with respective back sides 314, 324 of the first and/or second substrates 310, 320 of the dual-sided two-ply direct thermal image element 300.

One or more platens 450, 460 may further be provided for facilitating imaging by the third and/or fourth thermal print heads 430, 440, and/or to provide means for transport of the dual-sided two-ply direct thermal image element 300, and various plys thereof, along the media feed path 425 of the printer 400. Where so utilized, one or more of the platens 450, 460 may be further coupled to a drive mechanism 412 comprising one or more motors, gears, pulleys, belts and the like as further described in, inter alia, U.S. Provisional Application No. 60/779,781 entitled "Two-Sided Thermal Printing," the contents of which are hereby incorporated by reference herein.

While, as further shown in FIG. 3H, printing surfaces of the first and second thermal print heads 410, 420 are used as platens for the respective, opposite, second and first thermal print head 420, 410, additional, separate roller and/or plate type platens (not shown) may be provided for use by the first and/or second thermal print heads 410, 420. Additionally or alternately, a surface, including a printing surface, of either or both of a third and/or fourth thermal print head 430, 440 may be used as a platen for a first and/or second thermal print head 410, 420, as further described in U.S. patent application Ser. No. 11/678,216 entitled "Two-Sided Thermal Print Configurations," the contents of which are also hereby incorporated by reference herein.

As also shown in FIG. 3H, a dual-sided, two-ply direct thermal printer 400 may further include, inter alia, a dual-sided thermal printing function switch 470, one or more memory or buffer elements 480, a processor or controller 490, and/or a communication module 496, as collectively further described in U.S. patent application Ser. No. 11/675,649 entitled "Two-Sided Thermal Print Switch," the contents of which are hereby incorporated by reference herein. Likewise, one or more sensors 500 may be provided to, inter alia, sense an installed media type, sense thermal or other print, including one or more sensemarks, and/or provide one or more additional signals for control of a dual-sided two-ply direct thermal printer 400 as further described in U.S. patent application Ser. No. 11/644,262 entitled "Two-Sided Thermal Print Sensing," the contents of which are also hereby incorporated by reference herein.

As further shown in FIG. 3H, one or more thermal print heads 410, 420, 430, 440, and platens 450, 460, among other components of a dual-sided two-ply direct thermal printer 400, may be coupled to, or formed integrally with, one or more support arms 414, 416 which support arms may also be rotatable with respect to one another about a pivot 418 to facilitate, inter alia, media installation and printer servicing.

Variations comprising, for example, three thermal print heads 410, 420, 430 for, for example, printing on three thermally sensitive surfaces of a dual-sided direct thermal image element 300 (see, e.g., FIG. 3F), and/or replacement of the third and fourth thermal print head 430, 440 with a single, dual-sided thermal print head comprising two thermal print surfaces in a single support or package, are also possible.

In some embodiments, a dual-sided direct thermal printer such as those described with respect to FIGS. 1 and 3H may be associated with, for example, a stationary computing system such as an automated teller machine, a desk-top computer, a point-of-sale terminal, a self-service kiosk, and the like, for imaging of a dual-sided two-ply direct thermal image element 300. Alternately, a dual-sided direct thermal printer (e.g., printers 10 and/or 400 of FIGS. 1 and 3H) may be provided in the form of a portable printer carried or otherwise transported by, for example, a waiter or waitress, an automobile rental staff member, a retail clerk, a hospital employee, a public safety officer, and the like.

In one embodiment, information printed in one or more thermally sensitive coatings 316, 318, 326, 328 associated with a dual-sided two-ply direct thermal image element may comprise information relating to a merchant-customer transaction. Such information may include merchant information such as establishment name, address, and telephone number, customer information such as customer name, and payment means (e.g, cash, credit card, etc.), and transaction information such as purchased items name, stock or inventory number, price, and the like, any or all of which may be printed on any or all thermally sensitive coatings 316, 318, 326, 328. Additional information such as one or more store, establishment, and/or product logos, advertisements, coupons, contest information, legal information (e.g., disclaimers, warrantees, etc.) and the like, may also be provided in one or more provided thermally sensitive coatings.

In some embodiments, information may also be pre-printed on one or more sides 312, 314, 322, 324, above or below any provided base and/or top coat (not shown), and/or on one or more thermally sensitive coatings 316, 318, 326, 328, associated with the respective substrates 310, 320 comprising a dual-sided two-ply direct thermal image element 300. Such pre-printed information may comprise any or all of the above described merchant information, customer information, and/or transaction information provided such information is known in advance of a merchant-customer transaction for pre-printing purposes. Further, such pre-printed information may be printed using any suitable printing means such as lithographic and/or flexographic processes.

As part of a merchant-customer transaction, a first substrate 310 associated with a dual-sided two-ply direct thermal image element 300 may be detached or otherwise separated from a second substrate 320 associated with the image element 300 to generate a first transaction receipt for delivery to the customer. Likewise, as part of the merchant-customer transaction the second substrate 320 associated with the dual-sided two-ply direct thermal image element 300 may be detached or otherwise separated from the first substrate 310 to generate a second transaction receipt for delivery to the merchant. Such first and second transaction receipts may be separated or otherwise detached from a dual-sided two-ply direct thermal image element 300 manually (e.g., after printing), or during the printing process by a suitable dual-sided direct thermal printer, such as the dual-sided two-ply direct thermal printer of FIG. 3H.

In an embodiment, a method of generating separate merchant-customer receipts utilizing a dual-sided two-ply direct thermal image element 300 may comprise thermally printing first information on the first side of the first substrate; and thermally printing second information on the first side of the second substrate, wherein the first and the second information comprises merchant-customer transaction information. Such method may further comprise detaching the first substrate from the second substrate, and delivering the first substrate to the customer and the second substrate to the merchant. As previously described, the first substrate 310 may be manually detached from the second substrate 320 of a dual-sided two-ply direct thermal image element 300, or detached through use of a suitable dual-sided direct thermal printer such as the dual-sided two-ply direct thermal printer of FIG. 3H, which dual-sided two-ply direct thermal printer 300 may be associated with, inter alia, a point-of-sale terminal, or other computing system.

Figure 4:
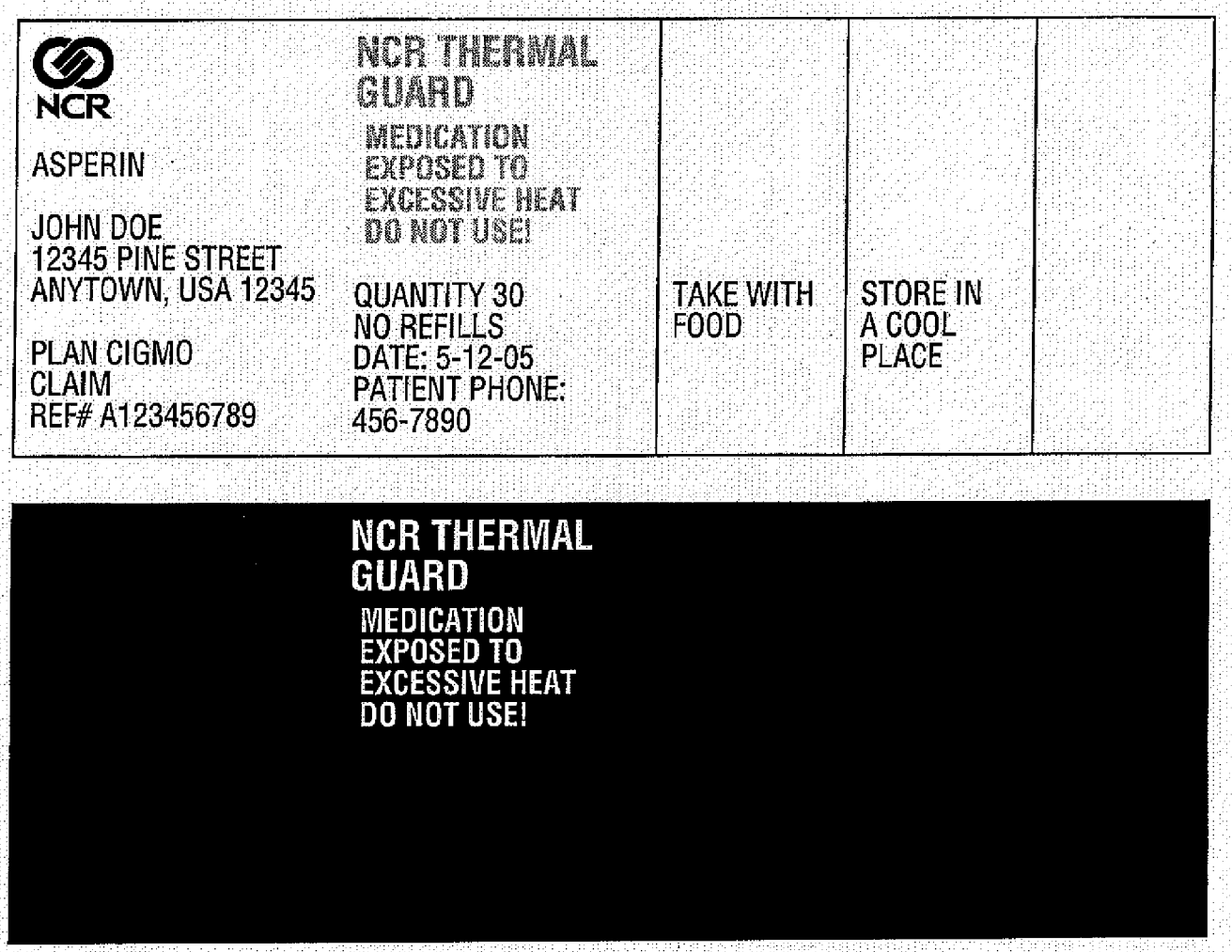
FIG. 4 shows an example two-sided thermal guard.

In additional embodiments, a dual-sided two-ply direct thermal image element 300 may further comprise hidden print (e.g., white print on a white background) on at least a first side 312 of a first substrate 310, wherein the hidden print becomes visible when the first side 312 of the dual-sided two-ply direct thermal image element 300 is imaged as further described with respect to FIG. 4. Such hidden print may comprise information for validating authenticity of the image element 300, such as, for example, a store or supplier logo, and/or may be used to convey additional information, such as notification of award of a prize, a coupon or other discount, and the like.

It should be noted that a dual-sided two-ply direct thermal image element may be provided in roll, fan-fold, and/or cut sheet stock form, a finished length of which may be set through one or more manual and/or automatic cut or severing means such as, inter alia, an automatic or manual (e.g., serrated edge) knife associated with a dual-sided direct thermal printer such as those described with respect to FIGS. 1A and 3H.

General Two-Sided Thermal Media Properties

Generally thermal media 20 can preferably be expected to have a thickness in the range of 1.8 to 70 mils, a weight in the range of 11 to 115 lbs/1300 SFR per ply, and an opacity in excess of 80%, depending upon the application or end-use requirements.

Two-Sided Thermal Paper with Security Feature

One or more security features may be added to one or both sides of a two-sided direct thermal printing imaging element to inhibit fraud or counterfeiting. Examples include applying thermochromic images and/or coatings to one or both sides of a two-sided thermal paper.

Two Sided Thermal Security

The trend towards thermal point of sale printing, electronic journaling and transaction bar coding has added another dimension in the prevention of receipt/return fraud. Many transactions are now assigned a unique bar code number on the point of sale receipt that can be traced back to the actual purchase while any items that have been previously returned can be identified. Security inks or materials offer another layer of loss prevention/fraud. The main purpose of adding security inks or materials is to minimize return/receipt fraud.

Several studies have indicated that overall "shrinkage" is a major concern for every retailer. Inventory "shrinkage", employee theft, shoplifting, vendor fraud and administrative errors cost the nation's retailers approximately $31.3 billion in 2002 or approximately 1.7% of their total sales.

There are many types of security inks or materials which could be applied to one or both sides of a two-sided thermal paper, or included in the substrate or coatings. These include:

Thermochromic

This is a heat sensitive ink that will change to a colorless state or another color when heat is applied (such as by rubbing), and then reverts to its original color when the heat is removed. It cannot be photocopied, is hard to duplicate, and is re-usable.

Scratch to Color

An ink that irreversibly changes from clear or a color to another color by scratching it, such as with a fingernail. It cannot be photocopied, is hard to duplicate, but is not re-usable.

Coin Reactive

A coin reactive ink is applied to the thermal paper, normally in a discreet or covert location. The image will change to gray when rubbed with the edge of a coin or other metal object. Cannot be photocopied, is covert, and is hard to duplicate.

Near Infrared Fluorescent

Ink, coating, or material (such as in the thermal substrate) that can be detected when exposed to light in the near-infrared spectrum, but is invisible to the naked eye. Cannot be photocopied, is hard to duplicate, and is re-usable, but requires a detection device.

Photochromic

An ink which undergoes a reversible color shift when exposed to UV light. The color reaction is immediate and reverts to its original color (or colorless) when the light source is removed. The ink can also be activated by natural sunlight. Cannot be photocopied, and is re-usable.

Watermark

White or clear ink used to produce an artificial watermark appearance. It cannot be photocopied, and is re-usable.

UV Fluorescent

Ink or coating which will fluoresce under short or long range UV light, or both. Normally is invisible to the naked eye. Cannot be photocopied, and is re-usable.

Fluorescent Fibers

Strands of material which can be added to the substrate or coating, and will fluoresce using a UV light. Cannot be photocopied, hard to reproduce, and is re-usable.

Taggants

Materials that are not visible to the naked eye, yet the structure is uniquely detectable by external means, such as microscope, light source, or chemical detection. Can be included in any part of the two sided thermal paper (substrate, subcoat, or thermal sensitive layer). Cannot be photocopied, extremely hard to reproduce, and are re-useable.

Color Shifting Inks

An ink, such as an optically variable ink, which will appear to be different colors when viewed from different angles. Cannot be photocopied, hard to reproduce, and is re-usable.

Holographic Images

A spot placed on one or both sides of the paper, in which the perceived image will change depending on the viewing angle. Cannot be photocopied, extremely hard to reproduce, and is re-usable.

Printing Patterns

A unique background or design, which is pre-printed on one or both sides of the two sided thermal paper. The design can be visible to the naked eye, or require a key to de-code the image. Is re-usable, and can be difficult to reproduce, depending on the design complexity.

Combination or Integrated Systems

This is when two or more of the above technologies are combined to produce multiple levels of security. The components must be compatible with each other, and be able to be detected independently. Generally provides the highest level of security.

An example of a combination system is NCR's "3-in 1" security ink. It is a patented (U.S. Pat. No. 5,883,043) application for thermal paper that contains three levels of security. Applying the ink to thermal paper creates a faint watermark effect, which cannot be copied. The second level of security is a fluorescent tracer, which can be seen using a UV light. The third level of security is that the ink contains a special wax resin which allows the image to be seen by applying any normal water-based highlighter pen.

Fraud Detection Methodology Using Two-Sided Thermal Paper

To authenticate a two sided direct thermal printing paper product, testing may include scoring both sides of the product, e.g., receipt, to prove an authentic or non-counterfeited document.

The characteristics of thermal paper allows for a low tech means of receipt authentication/non authentication for valid store receipts. One would be able to test each side of the 2 sided thermal paper by sliding/running/scraping a finger nail or and edge of a coin on the thermal paper coated side. Both sides would be tested as both sides have a thermal coating. A black line/mark would appear validating the receipt is a 2 sided thermal paper. For 2 sided thermal in a color configuration the image would appear in that color on one side and black on the other side. Example: if retailer A utilizes a black/blue 2 sided thermal paper roll then one side, when scratched, would image black, and the other side would image blue. The color should match the color print of the fired sample.

Multi-Color Two-Sided Thermal Printing

Two-sided direct thermal printing media can comprise multi-color capability on one or both sides, for printing in multiple colors on one or both sides of the media.

This application can provide for custom variable print two sided full color prints. The full color printing can be accomplished with crystalline dyes that transition from clear to colored in response to input from a thermal print head.

Direct thermal printers are used in many applications to provide information to a user. It is desirable to be able to provide variable information on both sides of a receipt or other document to save materials and to provide flexibility in providing information. A receipt or document can preprinted (e.g., by flexographic or lithographic printing) with some fixed information before variable information is added via the thermal printing process. It is desirable that variable information could be provided in full color on both sides of the paper. This capability can be used to include extra information in the minimum possible space, or alternately to provide advertising or couponing in previously unused space.

The media substrate can be either cellulosic (paper) based or polymeric (plastic) based. Suitable cellulosic materials include non-woven pulp based materials. Suitable polymeric materials can include polypropylene, polyethylene, or other materials known to those skilled in the art of direct thermal printing. All materials may use a combination of a sub-coat, a thermally sensitive functional coat, and/or a topcoat on each side. These layers may be applied to one or both sides of the film or substrate web as necessary to construct the final product.

The sub-coat may be of any suitable material to facilitate the adherence of the functional coat. One preferred material is a water-based mixture including mainly clay material. The water-based mixture can be spread on the substrate and then dried. This layer is often necessary to protect the functional coating from chemicals inherent to the substrate.

The functional coating can include dyes such as leuco dyes necessary for forming an image. At least three dyes must be present to make a full color image (cyan, magenta, and yellow). These dyes can be present as a mixture of crystalline dyes that change from clear to colored in response to application of heat. The dyes can be mixed with appropriate binders, additives, and solvents as required to allow ease of coating and proper functioning of finished products.

The topcoat may include any suitable components that serve to protect or enhance certain performance properties of the functional layer. This top coating could include water, UV, scratch, and smear inhibitors.

The coatings can be applied to the substrate by any suitable means such as flooding and metering, and subsequent drying. Alternately, spraying or dipping may be used instead of flooding and metering. The materials can be manufactured with any suitable process or apparatus, such as conventional in-line paper coating machines.

The image element is preferably printed in a suitable dual-sided imaging direct thermal printer as described in U.S. Pat. No. 6,759,366.

A variety of applications are available for two-sided multi-color thermal printed media. The media may include: single color printing on both sides, single color printing on one side and full color printing on the other side, or full color printing on both sides. The substrate can be either cellulosic (paper) based or polymeric (plastic) based. Suitable cellulosic materials include non-woven pulp based materials. Suitable polymeric materials include polypropylene, polyethylene, or other materials known to those skilled in the art for thermal printing. All imaging materials may use a combination of subcoat, functional coat, and/or topcoat. These layers may be applied to one or both sides of the film or substrate as necessary to construct the final product. For detailed descriptions of layers and their composition see U.S. Pat. No. 6,784,906 to Long et al. (e.g., at Column 3, lines 22-54).

The functional or thermally sensitive layer may be composed of single color thermal imaging components or multiple (full) color thermal imaging components. Single color layer/layers can be comprised of leuco dyes. Multiple color layer/layers, e.g., can be comprised of at least three types of colorless dye crystals that change from clear to colored with the application of heat. At least three colors (cyan, magenta, and yellow) would be used to allow for full color images. The two-sided multi-color media can be printed in a printer utilizing at least two thermal print heads. When the printer images the media, pulses of heat from the thermal print head cause the dyes to image.

Printed articles can be divided into multiple categories based on the physical properties of the media for printing with single or multiple color direct thermal printing. The categories include: cards, tickets, receipts, very small tags, letter size (8.5"×11"), and large size. Each category will have specific targets for size, thickness, substrate, opacity, and protective layers. Multiple color printing could be used, for example, to print a photograph or other identifying indicia on one or both sides of a document or item.

Cards:

Size: 1.5" to 3" in width, 2" to 4" in length

Thickness: 8 mil to 35 mil

Substrate: Cellulosic or polymeric (preferred)

Opacity: Generally opaque

Protective Layers: Coatings or films to impart H2O, UV, scratch & smear resistance.

Potential Applications: Room keys, cruise security, medical cards, credit cards, business cards, retail giftcards, cards with RFID embedded, corporate security cards, government security cards, trade show or conference security, small photo point of purchase photographs, library cards, parking permits, luggage tags, ID badges, and government high security cards.

Tickets:

Size: 1" to 4" in width, 2" to 8" in length

Thickness: 1.5 mil to 25 mil

Substrate: Cellulosic (preferred) or polymeric

Opacity: Generally opaque

Protective Layers: Coatings or films to impart water, UV, scratch, & smear resistance.

Potential Applications: Boarding passes, tickets, gaming and lottery tickets

Receipts:

Size: 2" to 8" in width, variable length

Thickness: 1.5 mil to 5 mil

Substrate: Cellulosic (preferred) or polymeric

Opacity: Generally opaque

Protective Layers: Generally not necessary, maybe UV resistance.

Potential Applications: ATM receipts/statements, receipts, point-of-sale receipts, kiosk information.

Very Small Tags:

Size: ½" to 2" in width, 1" to 4" in length

Thickness: 8 mil to 35 mil

Substrate: Celulosic (preferred) or polymeric

Opacity: Generally opaque.

Protective Layers: Generally not necessary, maybe environmental resistance.

Potential Applications: Shelf-edge labeling, RF key fobs, price tags, clothing hang tags.

Letter Size:

Size: Generally 8.5"×11", but can vary depending on application.

Thickness: 3 mil to 15 mil

Substrate: Cellulosic (preferred) or polymeric

Opacity: Generally opaque except decals which are generally clear.

Protective Layers: Generally not necessary.

Potential Applications: Direct mail coupons and advertisements, POS signage, labels, stationary, low volume roll-in-feed, pharmacy scripts, window decals, voting machine paper, plotter paper, business or home office correspondence, maps, fax paper, or medical graph paper.

Large Size:

Size: Generally larger than 8.5"×11", can be up to 48" width and 10 ft long.

Thickness: 5 mil to 25 mil

Substrate: Cellulosic or polymeric

Opacity: Generally opaque

Protective Layers: Water and UV resistance.

Potential Applications: Wide format signage and advertising.

Single or Multi-Color Two-Sided Applications

Applications can include, for example, a boarding pass or other security document which has a holder's photo or other identifying image printed on one side by direct thermal printing of two-sided direct thermal printing media.

Fan-Folded Two-Sided Thermal Print Media

Two-sided thermal print media can be fanfolded along lines of perforation for feeding to a printer, e.g., for pharmacy script application. Media may also include sensemarks for positioning of print (see, e.g., pharmacy paper). In such pharmacy applications, a medication script can be printed from fan-folded print media at the time of customer pick-up.

Two-Sided Thermal Paper with Spot Color

To save costs thermally sensitive coatings, including multicolor coatings, may be applied as a spot or pattern as opposed to a full side coating, where printing only over a limited area is desired.

Two-Sided Thermal Labels

A 2 sided thermal paper nested label combination is especially useful when used in form/label combinations. The 2 sided thermal paper allows the front and back of the laminate to be imaged. A feature not possible with 1 sided thermal is that labels may be taken from the front and back of the laminate.

Label release materials can include spot or patterned silicone. This can be done using UV cured silicone. The preferred adhesives are hot melt. Great care must be taken to prevent imaging the thermal paper. Waterbased and UV cured adhesive can also be used.

A 2 sided thermal form/label combination has all of the advantages of 2 sided thermal:

Simple robust printer. Resulting in reduced service calls, fewer jams, only 1 consumable.

Rapid time to first print.

2× print speed as compared to 1 sided thermal.

Reduced cost for consumables.

The integrated label could be made as a liner patch or a label patch. Example applications include pharmacy script and shipping label/packing lists.

Liner Patch

Non-Thermal liner

Adhesive is applied to the silicone side of the liner. The liner is then applied to the basesheet. The label is cut from the basesheet. The backside of the liner is not imagable. The adhesive may be hotmelt, water based or UV/EB cured. Hot melt is the most common. Note that the hot melt adhesive must be cooled before laminating the liner to the basesheet.

Direct Thermal Liner

In this case the liner is a 1 sided direct thermal sheet. The non-imaging side of the sheet is siliconized. UV or EB cured silicone is preferred. The silicone may be patterned or a continuous layer. Adhesive is applied to the silicone side of the liner. The liner is then applied to the basesheet. The label is cut from the basesheet. The adhesive may be hot melt, water based or UV/EB cured. Hot melt is the most common. Special care must be taken to prevent heat from imaging the liner or basesheet during processing. Premature imaging during the application of the hot melt adhesive should be prevented (e.g., by using a chilled vacuum roller, chill roller followed by a vacuum roller, etc).

Label Patch

In this case a patch of silicone is placed on the basesheet. Adhesive is applied to the non-imaging side of a direct thermal patch. The patch is then laminated to the basesheet. The patch can be subdivided with die-cuts into smaller labels. The adhesive may be hot melt, water based or UV/EB cured. Hot melt is the most common. Special care must be taken to prevent heat from imaging the patch or basesheet during processing. Preventing premature imaging during the application of the hot melt adhesive may be prevented through use of, inter alia, a chilled vacuum roller, a chill roller followed by a vacuum roller, etc.

The label-patch need not be the same material as the basesheet. The label can be a higher quality or more expensive material. An example of this would be a patch containing a multi-color coating, such as that described in U.S. Pat. No. 6,906,735. This would allow for a full color label and a mono-color printing on the rest of the basesheet.

Edge Joined

The Edge Joined method attaches a direct thermal laminate to the edge of a two-sided thermal sheet. Various methods are used to join the label material and the basesheet.

Two-Sided Thermal Guard

A method is provided for safe guarding medication in pill bottles from excessive thermal exposure. The safe guard is an integral part of the label on the bottle. In a simple embodiment a warning message is pre-printed on a white direct thermal label using opaque white ink. The white on white printing is initially invisible. When the label is exposed to excessive temperature the entire label images (e.g., turns black). The invisible white printing becomes visible. This process is illustrated in FIG. 4.

FIG. 4 illustrates the Thermal Guard concept. The top shows the Thermal Guard label before exposure to an excessive temperature. In FIG. 4 the invisible printing is shown as light gray, on the actual label it would be invisible. The bottom shows the label after exposure to an excessive temperature.

The white warning message is optimally placed on a portion of the label not thermally imaged. This is depicted in FIG. 4. By adjusting the opacity of the white ink it is possible to place the invisible print on areas of the label that are thermally printed. This is accomplished by adjusting the opacity of the white to allow the thermally imaged areas to appear gray through the white pre-printing. As long as the thermal printing is sparse an observer will not detect the hidden message.

Using two side thermal paper, a white warning message can be optimally placed on the back of the material that makes up a prescription label. This will free up imaging space on the front of the label for vital prescription information. Using clear or amber colored containers, the warning message can be viewed through the container. Placing the warning message on the back side of the label also serves to preserve the integrity of the warning feature and prevents latent exposure to surface contaminates or chemicals.

Alternately, the white warning message can be placed on both the front and back side of the two sided thermal paper that makes up a prescription label. This will provide a dual side feature.

Misc. Comments

The activation temperature for revealing the hidden message can be adjusted by changing the sensitivity of the paper.

The opaque white may be above or beneath a protective layer.

This application is not limited to white paper and white ink.

This application is not limited to black thermal imaging. Other color thermal papers can be used.

This same idea could be used as a security feature. When the paper is thermally printed an area is intentionally printed to expose the hidden print. This authenticates the media.

Two Sided Pharmacy Label Application

Basic Idea

The amount of information that is required on pill bottles is constantly increasing. This requires larger and larger pill bottle labels. This requires larger pill bottles be used. The pill bottles are already much larger than required to contain the pills. It is desirable to use small pill bottles as they are more cost efficient. This application allows for variably printed labels with extended printable areas.

In this application the length of the label is longer than the circumference of the bottle. Thus, the label wraps on top of itself when applied to the bottle. The front side of the label is covered with silicone release coating. This makes is easy to unwrap the portion of the label stuck on itself. The part of the label stuck to the bottle does not easily release from the bottle. In this way the end user can unwrap a portion of the label to reveal additional information.

Using 2 sided thermal linerless labels it is possible to print on both sides of the label. It is possible to image direct thermal paper through the silicone coating. The image on the adhesive side is generally restricted to the non-adhesive areas.

Note that this application applies to 1 sided and 2 sided thermal papers. This idea can be implemented using rolls, fanfold or sheeted labels. This idea also works with form/label combinations. Note that form/label combinations are dominant in the pharmacy market today.

Two-Sided Direct Thermal Form/Card Combinations

An illustrative method for making 2 sided direct thermal form/card combinations is now described. A form/card combination comprises two parts: the form or basesheet and the card. The form/card combination can be preprinted with information. Examples of this include a store logo and decorative artwork. This can be done using a printing press. The form/card combinations are then printed with variable information. Examples of this include customer name, customer address and identification numbers. This printing could be done with laser printers, inkjet printers, direct thermal printers or thermal transfer printers. The form/card combination is then delivered to the customer. This is often done via mail. Typical uses for form/card combinations include insurance cards, licenses, rewards card, membership cards, temporary identification cards, post cards and the like.

Exemplary Process Description

Figure 5A:
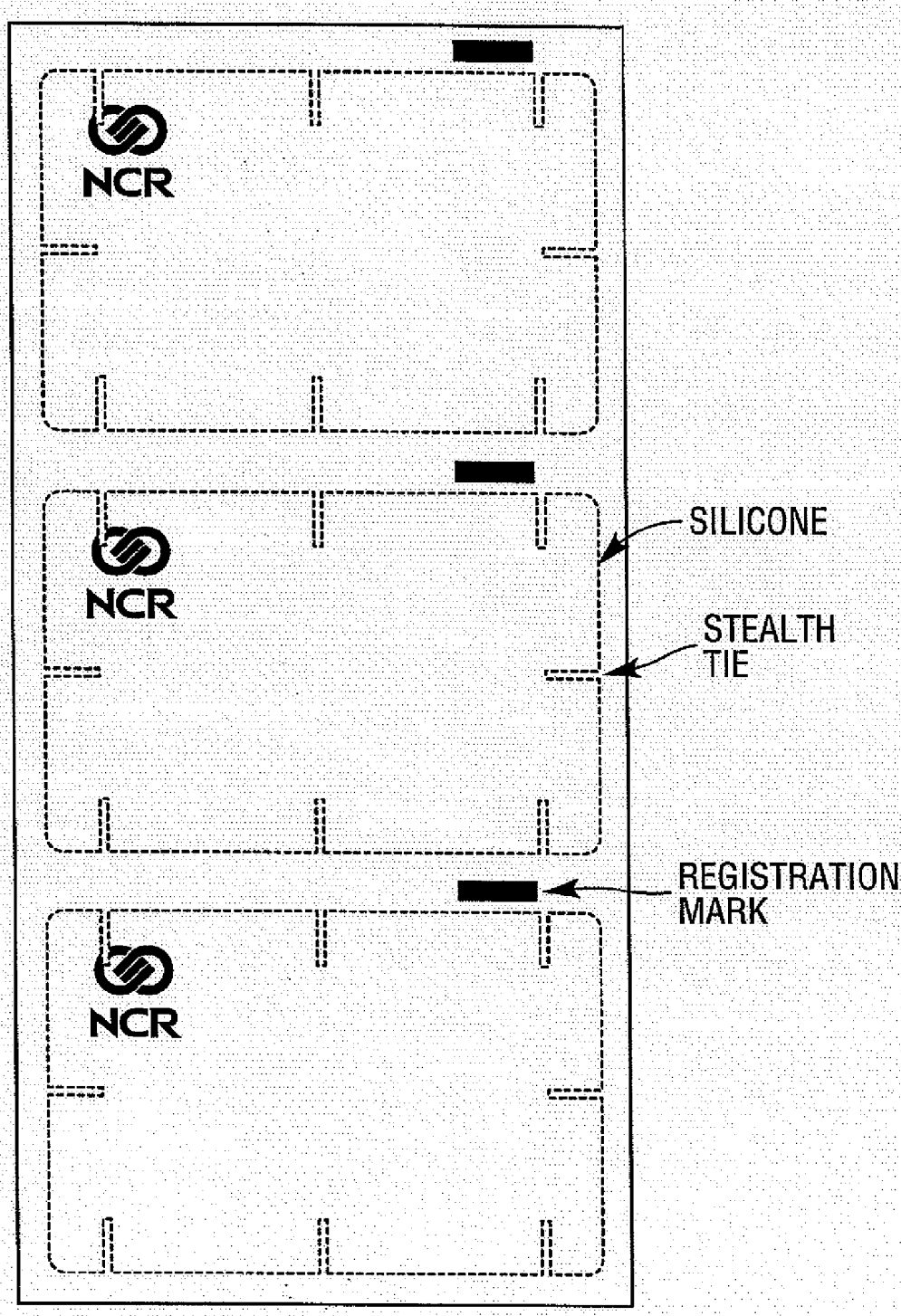
FIG. 5A shows example siliconized patches from a flexographic press for use in a two-sided thermal form/card combination.
Figure 5B:
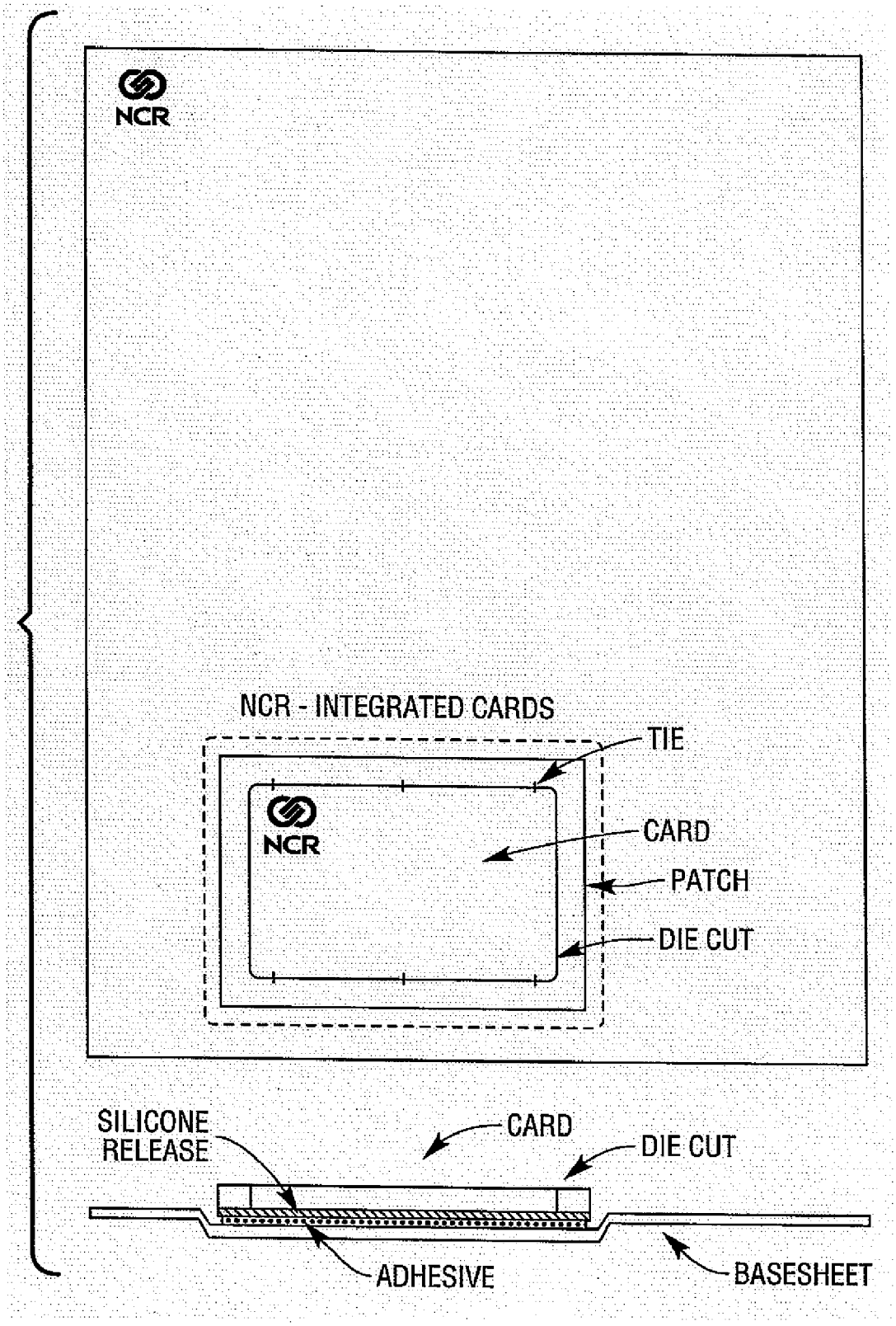
FIG. 5B shows an example of a two-sided thermal form/card combination.

This process for form/card combination fabrication comprises three steps. The first step is to produce a roll of siliconized patches using a 1 sided direct thermal stock. The cards will be cut from the patches in the final step. The patches could be produced on a flexo press. FIG. 5A shows a typical section of web as it comes off of a flexo press. Print on the backside, underneath the silicone, is also possible but not shown in the diagram. The patch of silicone is preferably sized slightly larger than the card. This is shown in FIG. 5B. The purpose of the stealth ties is to help hold the card in place. Stealth ties are optional. Some paper/silicone combinations may require a coating between the paper and the silicone. This coating is not shown.

The second step is to produce the form portion of the form/label combination. This can be done using a 2 sided thermal base sheet. The product of this step is a roll of base sheets. The base sheets may be embossed to form a slight depression that the patch is placed into. This embossing is shown in FIG. 5B. Embossing is done to decrease the protrusion of the patch above the plane of the base sheet. Embossing is optional.

Figure 5C:
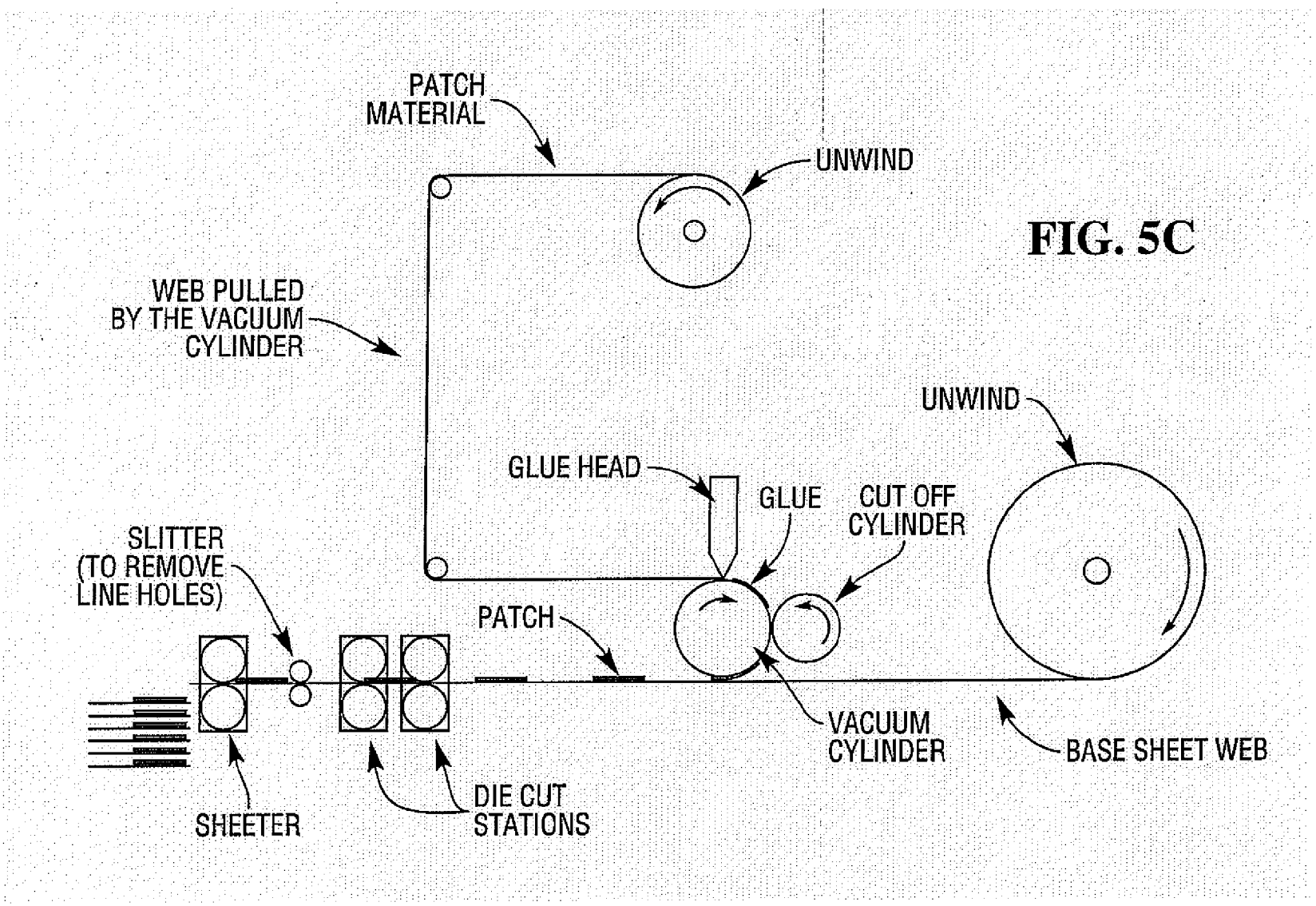
FIG. 5C shows an example apparatus for joining a patch and a base sheet to form a two-sided thermal form/card combination.

The third step is to join the patch and the base sheet together. This process is illustrated in FIG. 5C. In this process a hot melt adhesive can be coated to the backside of the patch. Special care should be taken to prevent imaging the direct thermal paper. The adhesive is important to this process. This adhesive is designed to be sticky in the melt and to retain the stickiness for a short period of time after being cooled to room temperature. This sticky-time at room temperature is called the open time. After the open time has expired the adhesive is no longer sticky. This process requires a hot melt adhesive with a sufficiently long open time. After the patch receives the adhesive coating it is cut from the web and then laminated to the base sheet. At the point of lamination the bond between the non-siliconized portions of the patch and the base sheet becomes permanent. The bond between the siliconized portion of the card and the adhesive is removable. Shortly after lamination the open time expires. The card is then die-cut from the patch. The card is cut from the area directly above the silicone (see FIG. 5B). The removable bond between the silicone and the adhesive keeps the card in-place until the end user removes it. Note that the adhesive is not tacky when the card is removed. Stealth ties and/or regular ties can be used to enhance the bond between the card and base sheet.

This process produces form/card combinations with all of the advantages of 2 sided thermal paper:

Simple robust printer. Resulting in reduced service calls, fewer jams, only 1 consumable.

Rapid time to first print.

2× print speed as compared to 1 sided thermal.

Reduced cost for consumables.

This process has several desirable characteristics: The material choice for the base sheet and card are no longer linked. This allows for the use of more economical base sheet materials as compared to traditional form/card combinations.

The independent choice of base sheet and card materials allows for the use of specialty media for the cards. For example, it is possible to produce a form/card combination using photographic quality paper for the card. This facilitates the production of form/card combinations for photo identification applications. It would be more expensive to make the entire form/card combination out of color direct thermal paper.

Reducing the caliper of the base sheet reduces the final mass of the form/card combination. This is a cost reduction for mailing.

The use of a non-pressure sensitive adhesive can reduce adhesive build-up in the printer as compared to a pressure sensitive adhesive.

FIG. 5A shows 3 example repeats of patch material as it comes off the flexo press. The dashed areas represent the silicone on the backside of the media web. Note the silicone is shown through the web. The registration mark is also shown through the web. A logo (e.g., an NCR logo) is on the front side of the web.

FIG. 5B shows an example form/card combination. The top is a view from the front of the form/card combination. The bottom is a cross-sectional view taken through the center of the card. The region below the card represents a silicone release layer. The region below the silicon represents an adhesive layer. This form/card combination is shown with ties. The ties are optional.

FIG. 5C shows an example process used to combine the patch and base sheet. The machine depicted in this diagram also die-cuts the card and sheets the form/card combination.

Security Characters for Two-Sided Thermal Lottery Tickets or Other Documents

Security numbers or characters can be printed on one or both sides of a dual-sided thermal printing media element such as a lottery ticket or other document. In the lottery industry there has been a shift from transaction prints using bond paper tickets to transaction prints using direct thermal tickets. Traditionally, lottery and secure ticketing applications required effective security controls, preprinted security features, and strict security methods designed to validate and authenticate winning tickets.

One important security feature that has been used for both bond paper and single side direct thermal paper tickets is the use of a consecutive number. Consecutive numbers can be preprinted along with other security inks/features by the ticket converter, or the consecutive number can be generated by the lottery ticket printer.

Preprinted consecutive numbers can be applied to either bond or direct thermal tickets, and are readily available today. Depending on the lottery system protocol and variable print security program, consecutive numbers can also be printed by the lottery ticket printer. With existing single side thermal technology, consecutive numbering applied by the ticket printer is limited to one side of the document.

Typically, consecutive numbers consist of a numeric or alpha numeric number, a consecutive bar code number, a modulus number, a gothic number, a MICR number, an OCR number, a CMC7 number, a 2D consecutive bar code, or a combination of several of these numbering systems.

A consecutive number generated by the lottery ticket printer provides a unique level of security. The number printed on a lottery ticket can be stored in a data base along with specific ticket details such as the transaction date and ticket selection information. This data can be recalled and compared to a physical ticket that is submitted for a "winning" claim. Ticket validation can then be confirmed. Although this is an effective system to validate a ticket, it is not a perfect or fool proof system. Damage or degradation of the thermally imaged number can occur. Whether through fraudulent or accidental alteration of a number, legal, time consuming claims and disputes can arise.

With the introduction of two sided thermal paper, another dimension in the prevention of ticket fraud and ticket validation can be addressed. Ticket transactions generated by the two side thermal ticket printer can be assigned a unique set of control numbers on both sides of the ticket. If damage or alteration occurs on one side of the ticket, the number applied to the other side can be used for validation. Security inks such as the ones listed below can be combined with the consecutive number generated by the ticket printer to provide an additional level of security.

Another variation of this dual numeric concept would be to have two integrally linked consecutive numbers. This security feature will create a unique identifier for document validation. Refer to the illustrations in FIG. 6.

Examples of Security Inks for Pre-Printing:

Near Infrared Fluorescent

Ink, coating, or material (such as in the thermal substrate) that can be detected when exposed to light in the near-infrared spectrum, but is invisible to the naked eye. Cannot be photocopied, is hard to duplicate, and is re-usable, but requires a detection device.

Watermark

White or clear ink used to produce an artificial watermark appearance. It cannot be photocopied, and is re-usable.

UV Fluorescent

Ink or coating which will fluoresce under short or long range UV light, or both. Normally is invisible to the naked eye. Cannot be photocopied, and is re-usable.

Printing Patterns

A unique background or design, which is pre-printed on one or both sides of the two sided thermal paper. The design can be visible to the naked eye, or require a key to de-code the image. Is re-usable, and can be difficult to reproduce, depending on the design complexity.

In summary, two sided thermal paper combined with this numeric/data security invention can provide a one of a kind solution in the lottery ticket industry by providing an added level of security and document validation.

Figure 6:
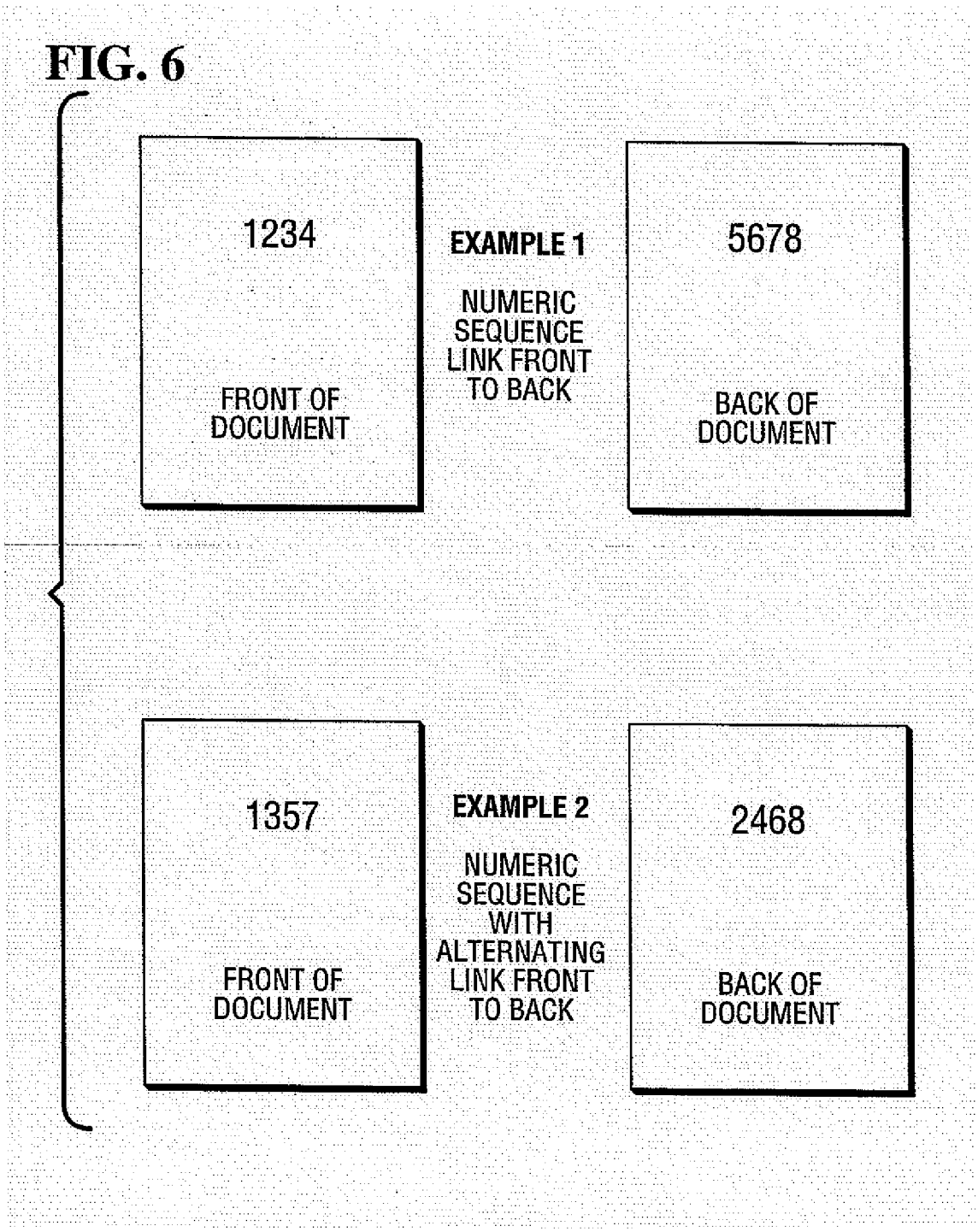
FIG. 6 shows example two-sided thermal alpha/numeric sequences for use in security control.

Illustrations of two-sided alpha/numeric sequences are provided in FIG. 6.

In the foregoing description, various features are grouped together in a single embodiment for the purpose of streamlining the disclosure. Likewise, various features are described only with respect to a single embodiment in order to avoid undue repetition. This method of disclosure is not to be interpreted as reflecting that the claimed embodiments should have more or less features than are expressly recited in each claim. Rather, as the following claims reflect, inventive subject matter lies in more or less than all features of a single disclosed embodiment. Thus the following claims are hereby incorporated into the description of the embodiments, with each claim standing on its own as a separate exemplary embodiment.

What is claimed is:

1. A dual-sided two-ply direct thermal image element comprising:

a first substrate having a first side and a second side; and a second substrate having a first side and a second side;

wherein both the first substrate and the second substrate include a thermally sensitive coating on at least a first side thereof and the first substrate further includes a thermally sensitive coating on the second side thereof, and wherein the second side of the first substrate is releasably attached to the second side of the second substrate.

2. The dual-sided two-ply direct thermal image element of claim 1, further comprising:

a first adhesive associated with the second side of the first substrate, wherein the second side of the first substrate is releasably attached to the second side of the second substrate via the first adhesive.

3. The dual-sided two-ply direct thermal image element of claim 2, further comprising:

a release layer associated with the second side of the second substrate, wherein the release layer facilitates release of the second side of the first substrate from the second side of the second substrate.

4. The dual-sided two-ply direct thermal image element of claim 2, further comprising:

a second adhesive associated with the second side of the second substrate; and a release liner situated between the first and the second adhesive, wherein the second side of the first substrate is removably attached to the second side of the second substrate via the release liner.

5. The dual-sided two-ply direct thermal image element of claim 1, wherein first information is thermally printed on the first side of the first substrate and second information is thermally printed on the first side of the second substrate.

6. The dual-sided two-ply direct thermal image element of claim 5, wherein the first and the second information comprises merchant-customer transaction information.

7. The dual-sided two-ply direct thermal image element of claim 6, wherein the first substrate comprises a customer receipt of the merchant-customer transaction and the second substrate comprises a merchant receipt of the merchant-customer transaction.

8. The dual-sided two-ply direct thermal image element of claim 7, wherein the first substrate is detached from the second substrate for delivery to the customer and the second substrate is detached from the first substrate for delivery to the merchant.

9. The dual-sided two-ply direct thermal image element of claim 8, wherein the first substrate is detached from the second substrate by a dual-sided direct thermal printer.

10. The dual-sided two-ply direct thermal image element of claim 9, wherein the dual-sided direct thermal printer is associated with a point-of-sale terminal.

11. The dual-sided two-ply direct thermal image element of claim 1, further comprising hidden print on at least a region of the first side of the first substrate, wherein the hidden print becomes visible when the region of the dual-sided two-ply direct thermal image element is imaged.

12. A method of generating a dual-sided two-ply direct thermal transaction receipt comprising a first substrate having a first side and a second side and a second substrate having a first side and a second side, wherein both the first substrate and the second substrate include a thermally sensitive coating on at least a first side thereof and the first substrate further includes a thermally sensitive coating on the second side thereof, and wherein the second side of the first substrate is releasably attached to the second side of the second substrate, the method comprising:

thermally printing first information on the first side of the first substrate;

thermally printing second information on the first side of the second substrate; and thermally printing third information on the second side of the first substrate.

13. The method of claim 12, wherein the first and the second information comprises merchant-customer transaction information.

14. The method of claim 13, further comprising detaching the first substrate from the second substrate.

15. The method of claim 14, further comprising:

delivering the first substrate to the customer; and delivering the second substrate to the merchant.

16. The method of claim 12, wherein the first and the second information are thermally printed by a dual-sided direct thermal printer.

17. The method of claim 16, further comprising detaching the first substrate from the second substrate by the dual-sided direct thermal printer.

18. The method of claim 16, wherein the dual-sided direct thermal printer is associated with a point-of-sale system.

19. The method of claim 16, wherein the dual-sided direct thermal printer comprises a portable printer operated by a merchant.

20. The dual-sided two-ply direct thermal image element of claim 1, wherein the second substrate further includes a thermally sensitive coating on the second side thereof.

21. The method of claim 12, wherein the first and the second information comprise merchant-customer transaction information, and wherein the third information comprises at least one of coupon, contest, and advertisement information.

* * * * *